US005125324A

United States Patent [19]

Araki et al.

[11] Patent Number: 5,125,324

[45] Date of Patent: Jun. 30, 1992

[54] PORTABLE HYDRAULICALLY OPERATED DEVICE INCORPORATING AUTOMATIC DRAIN VALVE

[75] Inventors: Masaharu Araki, Aichi; Toshiyuki Kumazaki, Inuyami, both of Japan

[73] Assignee: Daia Industry Co. Ltd., Aichi, Japan

[21] Appl. No.: 569,004

[22] Filed: Aug. 17, 1990

[30] Foreign Application Priority Data

| | | | |
|---|---|---|---|
| Feb. 10, 1988 | [JP] | Japan | 63-16481 |
| Oct. 12, 1988 | [JP] | Japan | 63-257873 |
| Feb. 28, 1990 | [JP] | Japan | 2-20770[U] |
| Mar. 30, 1990 | [JP] | Japan | 2-35381[U] |

[51] Int. Cl.[5] ..... F15B 11/08; F15B 13/04

[52] U.S. Cl. ..... 91/454; 91/418; 269/32; 269/238; 269/6; 294/88

[58] Field of Search ..... 91/47, 432, 446, 451, 91/468, 454, 457; 60/413, 417, 418; 81/57.44, 470, 301, 55, 93, 128; 417/234; 269/6, 32, 238; 294/88

[56] References Cited

U.S. PATENT DOCUMENTS

| | | | |
|---|---|---|---|
| 1,653,827 | 12/1927 | Trimble | 269/32 X |
| 2,752,754 | 7/1956 | Jaseph | 60/418 |
| 2,977,762 | 4/1961 | Dilworth | 60/418 X |
| 3,099,135 | 7/1963 | Hoadley | 91/47 X |
| 3,437,012 | 4/1969 | Bjorklund | 91/454 X |
| 3,593,824 | 7/1971 | Gregory | 60/413 X |
| 3,995,703 | 12/1976 | Wanner | 173/105 |
| 4,031,619 | 6/1977 | Gregory | 81/301 X |
| 4,085,587 | 4/1978 | Garlinghouse | 60/413 X |
| 4,251,055 | 2/1981 | Leong et al. | 254/2 B |
| 4,392,263 | 7/1983 | Amoroso | 81/485 X |
| 4,458,791 | 7/1984 | Schneider et al. | 60/413 X |
| 4,507,991 | 4/1985 | Lemke | 81/57.44 X |
| 4,733,895 | 3/1988 | Hawkes | 294/88 |
| 4,957,021 | 9/1990 | Helton | 81/57.44 |
| 4,959,957 | 10/1990 | Schmale et al. | 60/413 |

FOREIGN PATENT DOCUMENTS

| | | | |
|---|---|---|---|
| 2737653 | 3/1979 | Fed. Rep. of Germany | 91/454 |
| 3019305 | 11/1981 | Fed. Rep. of Germany | 91/47 |
| 53-47269 | 11/1978 | Japan . | |
| 0051104 | 4/1980 | Japan | 91/47 |

*Primary Examiner*—Edward K. Look
*Assistant Examiner*—John Ryznic
*Attorney, Agent, or Firm*—Oliff & Berridge

[57] ABSTRACT

A hydraulically operated device including a single-acting cylinder having a piston for operating a working tool, a pressure chamber for applying a hydraulic pressure to the piston from an original position to an operated position, and a return spring for biasing the piston toward the original position. The device includes a hydraulic pump for delivering a pressurized fluid to be fed into the pressure chamber of the cylinder, and an automatic drain valve for inhibiting the pressurized fluid from being discharged from the pressure chamber while a difference by which a delivery pressure of the pump is higher than a pressure in the pressure chamber exceeds a predetermined value. When the difference becomes smaller than the predetermined value, the automatic drain valve is operated to allow the pressurized fluid to be discharged from the pressure chamber. Thus, the automatic drain valve automatically drains the pressure chamber when the pump is turned off.

14 Claims, 24 Drawing Sheets

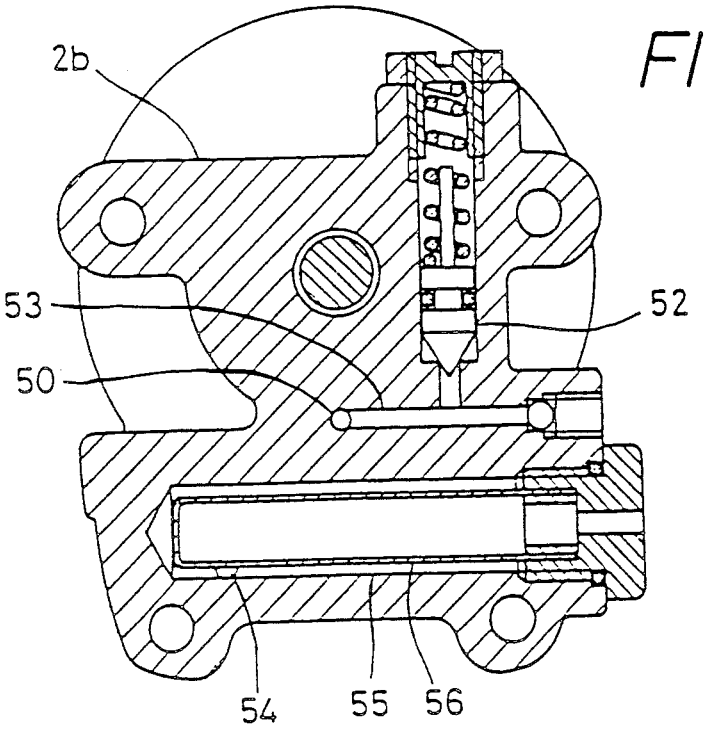
FIG. 5
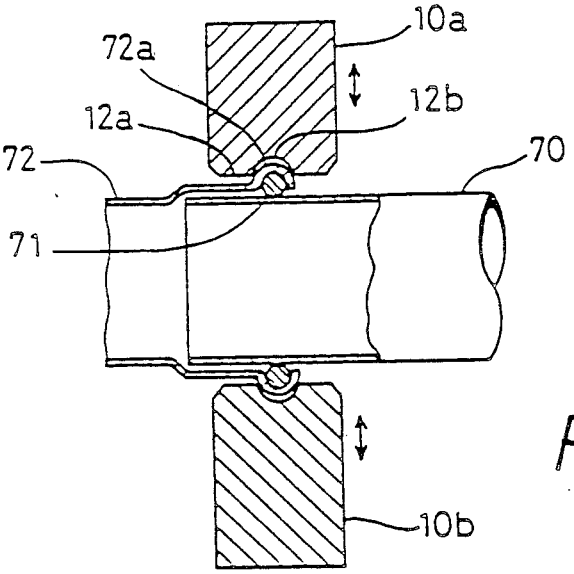
FIG. 6
FIG. 7
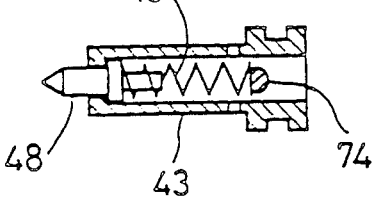
FIG. 8
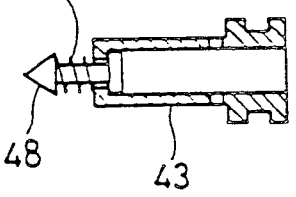

FIG. 26
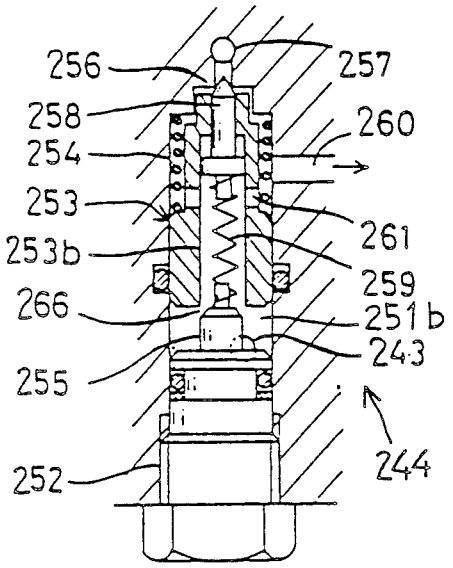
FIG. 29
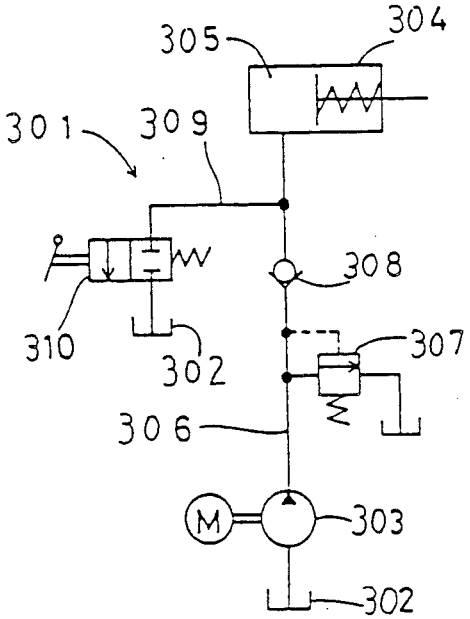
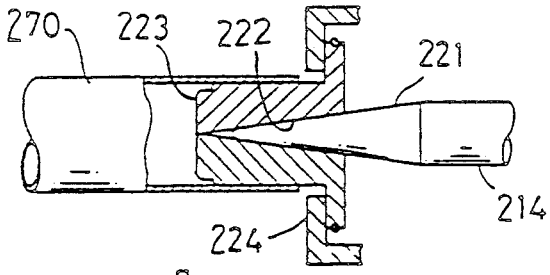
FIG. 27(a)
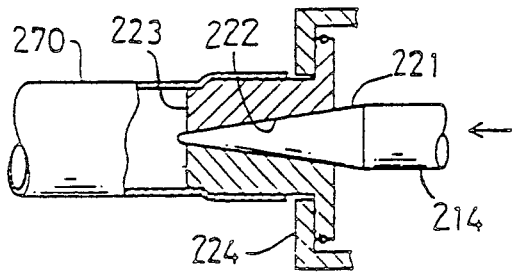
FIG. 27(b)

PORTABLE HYDRAULICALLY OPERATED DEVICE INCORPORATING AUTOMATIC DRAIN VALVE

BACKGROUND OF THE INVENTION

1. Field of the Invention

The present invention relates to a portable hydraulically powered or operated device adapted to work on a workpiece or workpieces, for performing a variety of operations such as processes involving plastic deformation of metals, clamping, caulking, drilling and cutting.

2. Discussion of the Prior Art

A relatively small-sized hydraulically powered device is widely used at job sites of plumbing and construction, for example. The device is either hand-held by the operator, or fixed on a work table. Generally, such a hydraulically powered device uses a single-acting cylinder to drive a working tool. The cylinder is hydraulically connected to a suitable hydraulic pump, so that a pressurized fluid is fed to a pressure chamber to move a piston and a piston rod, whereby the working tool is driven to achieve a desired operation on the workpiece. The piston is retracted to its home or original position by a return spring when the operation by the working tool is completed.

To retract the piston to the home position, it is required to turn off the hydraulic pump, and return the pressurized fluid from the pressure chamber of the single-acting cylinder to the hydraulic pump, by opening a fluid passage between the cylinder and the pump. Conventionally, a manually operated valve is provided in the fluid passage, so that the pressurized fluid is returned to the pump by opening this valve. After the piston is returned to the home position, the valve is operated to the closed position. Thus, the operation of the valve requires the operator to release the hand which has been engaged in holding the device. This may cause an inconvenience in performing the desired operation in the intended manner, and may reduce the working efficiency.

In view of the above drawback, a portable hydraulically operated device incorporating an automatically operated return valve is proposed as disclosed in laid-open Publication No. 53-47269 of examined Japanese Utility Model Application. This return valve is associated with a piston such that the return valve operates to open and close a fluid passage formed through the piston. The return valve is adapted to return the pressurized fluid from the pressure chamber to retract the piston to its home position when the piston has reached its stroke end. In this hydraulically operated device, however, the piston cannot be retracted before the stroke end of the piston is reached, that is, when it is desired to stop an operation on the workpiece for some reason or other, for example, when the operator finds an inadequate setup of the working tool or workpiece or some trouble after the working operation is started. Thus, this type of return valve is not practically satisfactory.

Usually, the hydraulic pump used for such a hydraulically operated device as described above is manually operated by reciprocating the operating lever several times. This pump is laborious and requires a relatively ample working space. Recently, the manually operated pump is replaced by an electrically operated pump. An example of such a hydraulic pump is indicated at 380 in FIG. 36, wherein the pump 380 is incorporated in a power unit 382 which includes, a reservoir 381, valves and other hydraulic components, as well as the pump. In this case, a single-acting cylinder 383 of a hydraulically operated device is generally connected to the power unit 382 through a relatively long hose 384. Further, a solenoid-operated valve 385 incorporated in the power unit 382 is controlled by a signal fed through a control cable. Thus, the control cable, and the hydraulic hose 384 (which is relatively heavy and inflexible) must extend between the power unit 382 and the working site of the device. Accordingly, the working site is limited, and the provision of the solenoid-operated valve 385 and the electric control switch for this valve increases the cost of the device as a whole. Further, the hydraulically operated device of the type shown in FIG. 36 is not suitable for performing a clamping operation, for example, for clamping workpieces to be welded together. More specifically, the power unit 382 employs a relief valve 387 disposed between the single-acting cylinder 383 and a check valve 386 near the delivery port of the pump 380. When the pump 380 is held off while maintaining the clamping pressure, the pressurized fluid in the system may leak through a minute clearance at the valve seat of the relief valve 387. To avoid this fluid leakage, the pump 380 must be kept operated during a welding operation on the clamped workpieces. This causes an increase in the working fluid and consequent deterioration of the fluid, and results in an increased energy consumption.

SUMMARY OF THE INVENTION

It is accordingly a first object of the present invention to provide a hydraulically operated device which is safe and efficient in operation and in which a piston of a single-acting cylinder is readily returned with a working fluid automatically discharged from a pressure chamber of the cylinder when a hydraulic pump is turned off.

A second object of the invention is to provide a simple, easy-to-operate hydraulically operated device suitable for a clamping operation, which maintains a desired clamping pressure while the hydraulic pump is held off.

The first object may be attained according to one aspect of the present invention, which provides a hydraulically operated device including a single-acting cylinder having a piston for operating a working tool, a pressure chamber for applying a hydraulic pressure to the piston from an original position to an operated position, and a return spring for biasing the piston toward the original position, the device comprising: (a) a hydraulic pump for delivering a pressurized fluid to be fed into the pressure chamber of the single-acting cylinder; and (b) an automatic drain valve for inhibiting the pressurized fluid from being discharged from the pressure chamber of the cylinder while the difference by which a delivery pressure of the hydraulic pump is greater than the pressure in the pressure chamber exceeds a predetermined value. When the difference is reduced to a value smaller than the predetermined value, the automatic drain valve allows the pressurized fluid to be discharged from the pressure chamber, whereby the pressure chamber is automatically drained when the hydraulic pump is turned off.

In the hydraulically operated device of the present invention constructed as described above, the automatic drain valve inhibits the pressure chamber of the single-acting cylinder from being drained with the pressurized fluid being discharged therefrom, while the hydraulic pump is normally operating, namely, while the delivery pressure of the pump is higher than the pressure in the pressure chamber by a predetermined amount or more. When the hydraulic pump is turned off, the difference between the delivery pressure of the pump and the pressure chamber becomes smaller than the predetermined value, and the drain valve is automatically operated to allow the pressurized fluid to be discharged from the pressure chamber of the cylinder. Thus, the piston rod can be easily returned from the operated position to the original position by simply turning off the hydraulic pump. This assures a safe and efficient operation of the working tool on a workpiece or workpieces.

Further, the automatic drain valve permits the piston rod to be returned to the original position from any position between the original and operated positions, by turning off the pump at any time after the pump is started, that is, at any time while the piston rod is moved toward the operated position.

The present hydraulically operated device is preferably a portable unit including the working tool mounted thereon and incorporating the hydraulic pump and the automatic drain valve. The portable unit has an operator-controlled switch for turning on and off the hydraulic pump. The portable unit may comprise an oil reservoir including a variable-volume chamber in which the pressurized fluid delivered from the hydraulic pump is stored. Since the reservoir is built into the portable unit, the required hydraulic system is entirely incorporated in the portable unit. As such, the portable unit does not require hydraulic hoses for connecting the reservoir and the pump, and is therefore easy to handle in operation. The oil reservoir may use an elastic member such as a rubber bag for partially defining the variable-volume chamber. In this case, one of the opposite surfaces of the elastic member is exposed to an atmospheric pressure while the other surface is exposed to a pressure of the fluid discharged from the pressure chamber of the cylinder. The volume of the variable-volume chamber varies with elastic deformation of the elastic member.

In one form of the present invention, the automatic drain valve comprises: means for defining a valve chamber; a primary valve member slidably received in the valve chamber, and cooperating with the means for defining a valve chamber, to define a first fluid chamber to which a delivery passage connected to the hydraulic pump is open, and a second fluid chamber to which a drain passage communicating with an oil reservoir and a feed-discharge passage communicating with the pressure chamber of the cylinder are open, the delivery pressure being applied to the first fluid chamber and acting on the primary valve member in a first direction, while the pressure in the pressure chamber being applied to the second fluid chamber and acting on the primary valve member in a second direction opposite to the first direction; and primary biasing means for biasing the primary valve member in the second direction. The primary valve member is moved to allow fluid communication between the delivery passage and the feed-discharge passage and prevent fluid communication between the feed-discharge passage and the drain passage, when a thrust force based on the difference exceeds a biasing force of the primary biasing means.

In one arrangement of the above form of the invention, the primary valve member has a bore formed in an axial direction, and the automatic drain valve further comprises a secondary valve member including a first portion slidably engaging the bore, and a second portion which projects from the bore so as to allow and prevent fluid communication between the drain passage and the second fluid chamber, and further comprises secondary biasing means for biasing the secondary valve member toward an end of the drain passage which opens to the second fluid chamber. In this case, the automatic drain valve may be constructed such that the end of the drain passage is open in an end face of the valve chamber which partially defines the second fluid chamber, so that the end face provides a valve seat, and so that a coned tip of the secondary valve member is seated on the valve seat while the thrust force based on the difference is larger than the biasing force of the secondary biasing means.

In the above arrangement, the automatic drain valve may be adapted such that the bore formed in the primary valve member communicates with the second fluid chamber. In this case, the means for defining a valve chamber may include a plug which partially defines the first fluid chamber and which has an extension extending into the first fluid chamber. The primary biasing means biases the primary valve member such that an open end of the bore of the primary valve member on the side of the first fluid chamber is closed by the extension to prevent fluid communication between the first fluid chamber and the bore, thereby preventing the fluid communication between the delivery passage and the feed-discharge passage.

Alternatively, the means for defining a valve chamber includes a plug which partially defines the first fluid chamber and which has a small-diameter hole, and the primary valve member includes a small-diameter portion which fluid-tightly engages the small-diameter hole. The small-diameter portion has a communication passage which is formed therethrough communicating with the bore such that an end of the communication passage remote from the bore is open in an outer surface of the small-diameter portion and is closed by an inner surface of the small-diameter hole while the thrust force based on the difference is smaller than the biasing force of the primary biasing means. The above-indicated end of the communication passage is brought into communication with the first fluid chamber to effect the fluid communication between the delivery passage and the feed-discharge passage, when the thrust force based on the difference exceeds the biasing force of the primary biasing means. The small-diameter hole may be a blind hole formed in the plug, or a through-hole formed through the plug.

Where the small-diameter hole is a through-hole, the small-diameter portion of the primary valve member extends through the through-hole such that an end of the small-diameter portion is positioned outside the plug while the thrust force based on the difference is smaller than the biasing force of the primary biasing means, that is, while the pump is not operating. When the pump is operated, the primary valve member is advanced in the direction from the first fluid chamber toward the second fluid chamber, whereby the small-diameter portion is moved inwardly of the plug. This movement of the small-diameter portion can be confirmed by observing the end face which is located outside the plug while the pump is not operating. Thus, the application of the fluid pressure to the pressure chamber of the cylinder can be easily confirmed by the position of the exposed end of the small-diameter portion of the primary valve member.

In the above case, the device may include a relief valve which is repeatedly opened and closed so as to maintain the pressure in the pressure chamber of the cylinder at a predetermined level after the pressure in the pressure chamber has reached the predetermined level, the primary valve member being oscillated in response to a repeated opening and closing operation of the relief valve. Accordingly, the fact that the pressure in the pressure chamber has reached the predetermined level can be confirmed by observing the end of the small-diameter portion which is positioned outside of the plug when the relief valve is opened If a caulking tool is attached to the end of the piston rod, for example, the fact that the piston has reached its stroke end indicates the completion of a caulking operation by the caulking tool. Thus, the completion of an operation of the working tool can be confirmed by the oscillation of the primary valve member in response to the repeated opening and closing operation of the relief valve, which oscillation can be confirmed by observing the exposed end of the small-diameter portion of the primary valve member. This arrangement therefore assures a highly reliable operation of the hydraulically operated device for performing the intended operation by the working tool.

The second object may be attained according to another aspect of the present invention, which provides a hydraulically operated device including a single-acting cylinder having a piston for operating a working tool, a pressure chamber for applying a hydraulic pressure to the piston from an original position to an operated position, and a return spring for biasing the piston toward the original position, the device comprising: (a) a hydraulic pump for delivering a pressurized fluid to be fed into the pressure chamber of the single-acting cylinder; (b) means for defining a delivery passage for connecting the hydraulic pump and the pressure chamber of the cylinder; (c) a relief valve connected to the delivery passage and operated when a pressure in the pressure chamber of the cylinder has reached a predetermined level; (d) a check valve disposed in a portion of the delivery passage between the pressure chamber of the cylinder and a point of connection of the relief valve to the delivery passage, the check valve inhibiting a flow of the pressurized fluid through the delivery passage in a direction from the pressure chamber toward the hydraulic pump; and (e) an operator-controlled shut-off valve connected to one of the pressure chamber of the cylinder, and a portion of the delivery passage between the pressure chamber and the check valve. The shut-off valve is manually operated to an operated position for discharging the pressurized fluid from the pressure chamber of the cylinder. The check valve and the shut-off valve function to maintain the pressure in the pressure chamber of the cylinder at the predetermined level after the hydraulic pump is turned off, until the operator-controlled shut-off valve is manually operated to the operated position.

In the hydraulically operated device constructed according to this aspect of the present invention, the pressurized fluid supplied from the hydraulic pump to the pressure chamber of the single-acting cylinder is maintained in the pressure chamber by the check valve and the operator-controlled shut-off valve in the closed position, even after the hydraulic pump is turned off. In other words, the piston of the cylinder is maintained at the position established when the pump is turned off. When the operation by the working tool driven by the piston is completed, the operator operates the shut-off valve to the open position for discharging the pressurized fluid from the pressure chamber of the cylinder and thereby allowing the piston to be returned to the original position under the biasing force of the return spring. The operator-controlled shut-off valve for draining the pressure chamber of the cylinder is simpler in construction and more economical to manufacture than a solenoid-operated valve as used in the conventional arrangement as shown in FIG. 36. Further, the check valve disposed between the relief valve and the pressure chamber of the cylinder prevents the pressurized fluid from leaking from the pressure chamber when the hydraulic pump is turned off. Therefore, if the working tool is used to clamp the workpiece, the desired clamping pressure may be maintained during a welding operation to be performed on the workpiece, for example. Moreover, the piston and the working tool may be stopped at a desired point within the operating stroke by turning off the hydraulic pump. The piston may be returned to the original or non-operated position by operating the shut-off valve to the open position. Thus, the present hydraulically operated device assures a high degree of safety and ease of operation.

In one form of the hydraulically operated device according to this aspect of the present invention, the operator-controlled shut-off valve includes an axially movable valve spool, a valve seat aligned with an operating end of the valve spool, a compression coil spring for biasing the valve spool in a first direction toward the valve seat, and an operating lever for moving the valve spool in a second direction opposite to the first direction.

The device preferably consists of a portable unit which includes the working tool mounted thereon and incorporates the hydraulic pump, the relief valve and the operator-controlled shut-off valve. The portable unit preferably incorporates an oil reservoir. In this case, the device does not require an external hydraulic hose for connecting the hydraulic pump to the reservoir, and is accordingly compact and easy to handle, with a reduced limitation in the operating sites and environments.

BRIEF DESCRIPTION OF THE DRAWINGS

The above and other objects, features and advantages of the present invention will be better understood by reading the following detailed description of presently preferred embodiments of the invention, when considered in connection with the accompanying drawings, in which:

FIG. 5 is a cross sectional view taken along line V—V of FIG. 2;

FIG. 6 is a cross sectional view showing clamp jaws of the device of FIG. 1 when the jaws act on a workpiece;

FIGS. 7 and 8 are illustrations in longitudinal cross section showing modified forms of a primary valve member and a secondary valve member used in the device of FIG. 1, respectively;

FIG. 26 is a cross sectional view showing a primary and a secondary valve member used in the device of FIG. 20;

FIGS. 27(*a*) and 27(*b*) are cross sectional views showing an expansible collet used in the device of FIG. 20 when the collet acts on a workpiece;

FIG. 29 is a schematic diagram illustrating a hydraulic circuit arrangement of a portable hydraulically operated device constructed according to a still further embodiment of this invention;

DETAILED DESCRIPTION OF THE PREFERRED EMBODIMENTS

Referring first to FIGS. 1–6, there will be described a first embodiment of the present invention.

Figure 1:
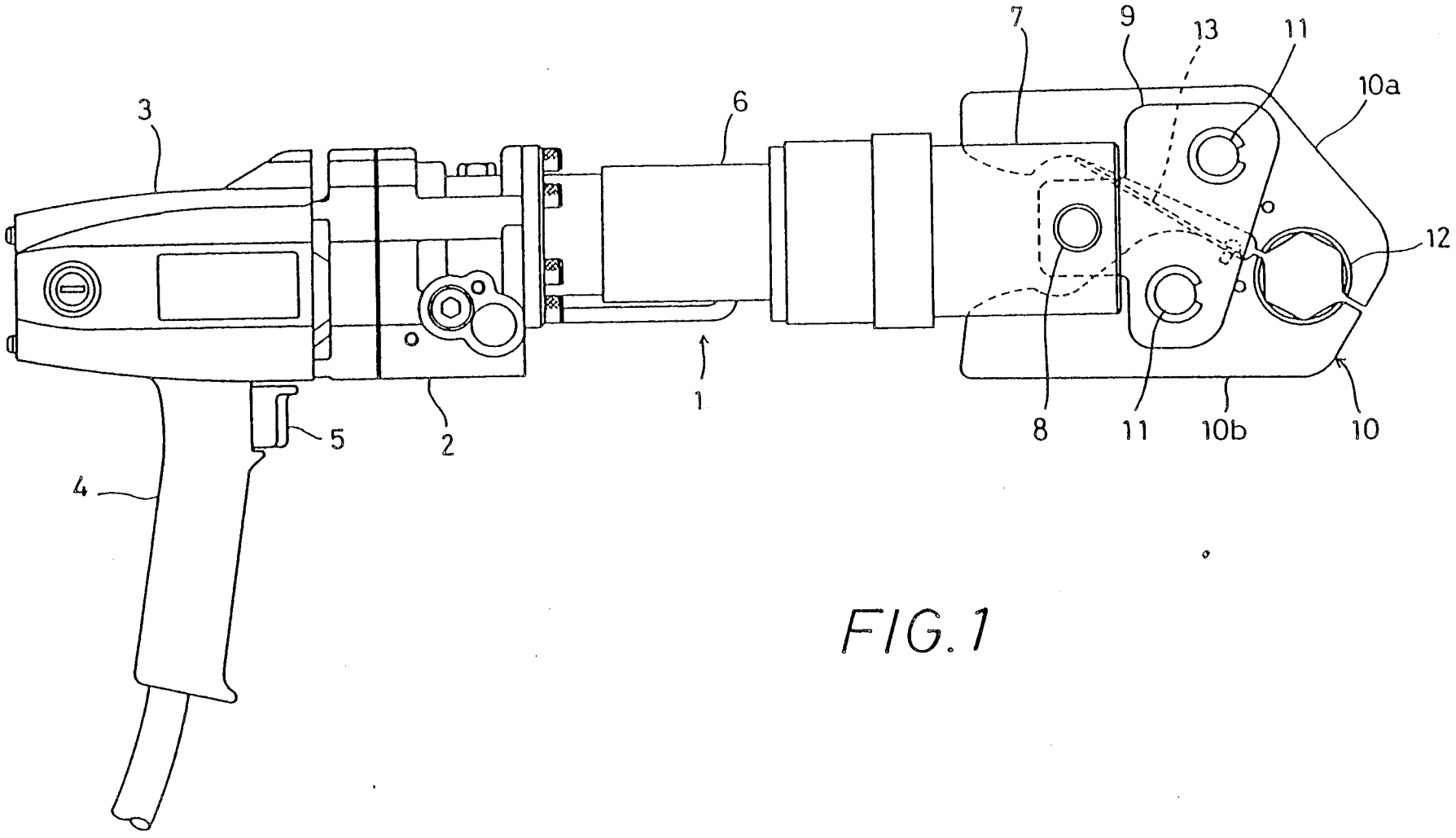
FIG. 1 is a front elevational view of one embodiment of a portable hydraulically operated device of the present invention.

In FIG. 1, reference numeral 1 generally denotes a portable hydraulically operated device, which includes a housing 2 accommodating a hydraulic pump 31 (which will be described) and various control valves. An electric motor 3 to drive the pump 31 (FIGS. 2 and 3) is attached to the housing 2 and is controlled by the operator by manipulating an operator-controlled on-off switch 5 provided on a handle 4 of the portable device. A pressurized fluid from the pump 31 is fed to a single-acting cylinder 6 attached to the housing 2. A bracket 7 secured to the front end of a cylinder body 61 of the cylinder 6 has a removably mounted pin 8, and carries a holder 9 by means of the pin 8. The holder 9 holds a clamping tool 10 in the form of a pair of clamping jaws 10*a*, 10*b* such that the jaws 10*a*, 10*b* are pivotally supported by respective pins 11 provided on the holder 9.

The clamping tool 10 has a clamping portion 12 at the free end portions of the upper and lower jaws 10*a*, 10*b*. The jaws 10*a*, 10*b* are biased by a sheet spring 13 so that the clamping portion 12 is normally placed in the closed position. As shown in FIG. 6, each of the two jaws 10*a*, 10*b* has a first clamping surface 12*a* and a second clamping surface 12*b*. In the closed position of the clamping portion 12, the first clamping surfaces 12*a* of the two jaws 10*a*, 10*b* cooperate to define a hexagonal caulking portion, while the second clamping surfaces 12*b* of the two jaws cooperate to define a circular or annular caulking portion.

The details of the interior construction of the portable hydraulically operated device are shown in FIGS. 2 through 5, wherein the housing 2 consisting of a gear casing 2*a* and a pump body 2*b* rotatably supports a drive shaft 22 operatively connected to the electric motor 3 through a gear 21 located within the gear casing 2*a*. The pump body 2*b* accommodates a slidably supported plunger 23, and a needle bearing 25 fitted on an eccentric cam 24 fixed on the drive shaft 22. The head of the plunger 23 is held in sliding contact with the outer circumferential surface of the needle bearing 25, under the biasing force of a compression coil spring 26. The plunger 23 is slidably received in a hole 30 in the pump body 2*b*, and is provided with a check valve 27. The check valve 27 is biased by a compression coil spring 29 disposed between the valve 27 and a cap 28 secured to the pump body 2*b*. Under biasing force of the spring 29, the check valve 27 is held in contact with a seat formed around the opening of the hole 30. Thus, the plunger type hydraulic pump 31 is provided. Reference numeral 32 designates a fluid delivery passage through which a pressurized fluid delivered from the pump 31 is fed. This delivery passage 32 communicates with a valve chamber 41 of an automatic drain valve 40. As described below, this drain valve 40 is automatically operated to drain an actuating pressure chamber 61*a* of the single-acting cylinder 6, when the pump 31 is turned off.

Figure 4:
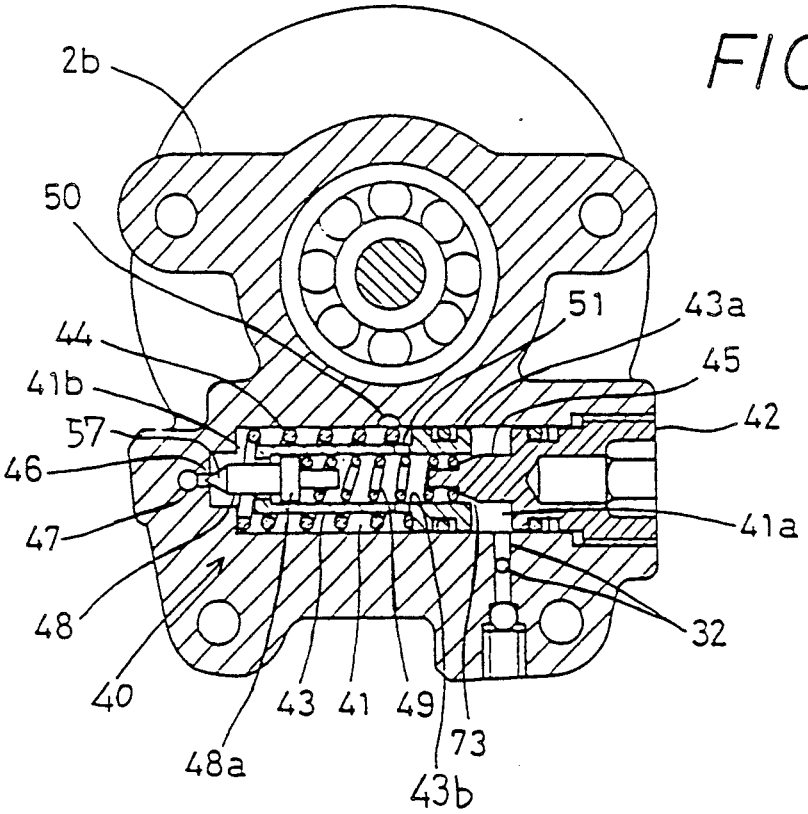
FIG. 4 is a cross sectional view taken along line IV—IV of FIG. 2.

Reference numerals 33 and 34 denote two oil reservoirs provided in the gear casing 2*a* and pump body 2*b*, respectively, which communicate with each other. The oil reservoir 33 communicates with a lower portion of the hole 30 through an intake passage 35 in the form of a slit. As shown in FIG. 4, the valve chamber 41 is defined by a round hole formed in the valve body 2*b*, and a plug 42 which closes the open end of the hole. The fluid delivery passage 32 opens in a first fluid chamber 41*a* of the valve chamber 41 (on the side of the plug 42). The valve chamber 41 receives a primary valve member 43 which has a flange portion 43*a* and a bore 43*b*. The flange portion 43*a* slidably engages the inner surface of the valve chamber 41, so that the primary valve member 43 is movable in its longitudinal direction, and divides the valve chamber 41 into the first and second fluid chambers 41*a*, 41*b*. The primary valve member 43 is biased toward the plug 42 (toward the first fluid chamber 41*a*), by a primary coil spring 44 disposed between the flange portion 43*a* and the surface of the valve body 2*b* which defines the end of the second fluid chamber 41*b*. The plug 42 has an extension 45 which extends into the first fluid chamber 41*a* of the valve chamber 41 and which has a tapered portion engageable with the open end of the bore 43*b* of the primary valve member 43. The valve body 2*b* has a valve seat 46 formed so as to define the end of a drain passage 47 which opens in the d fluid chamber 41*b*. The drain passage 47 communicates with the oil reservoir 33. The valve chamber 41 also receives a secondary valve member 48 of a needle type, which has a coned tip 57 engageable with the valve seat 46. More specifically, the valve member 48 has a flange portion 48*a* which slidably engages the bore 43*b* of the primary valve member 43, such that the end portion of the member 48 including the coned tip 57 extends through the bottom wall of the primary valve member 43. The secondary valve member 48 is biased by a secondary coil spring 49 toward the valve seat 46. The secondary coil spring 49 has a smaller diameter of the primary coil spring 44 and is disposed between the flange portion 48*a* and the extension 45 of plug 42.

Reference numeral 50 designates a feed-discharge passage which communicates at one end thereof with the actuating pressure chamber 61*a* of the single-acting cylinder 6, and at the other end with a portion of the second fluid chamber 41*b* around the outer circumferential surface of the primary valve member 43. The above-indicated other end of the passage 50 is not closed by the flange portion 43*a* of the primary valve member 43 even when the member 43 is moved to its fully advanced position on the side of the valve seat 46. The primary valve member 43 has communication holes 51 which communicate with the interior and exterior of the primary valve member 43, namely, with the bore 43*b* of the member 43 and the portion of the second fluid chamber 41*b* to which the feed-discharge passage 50 is open.

Figure 2:
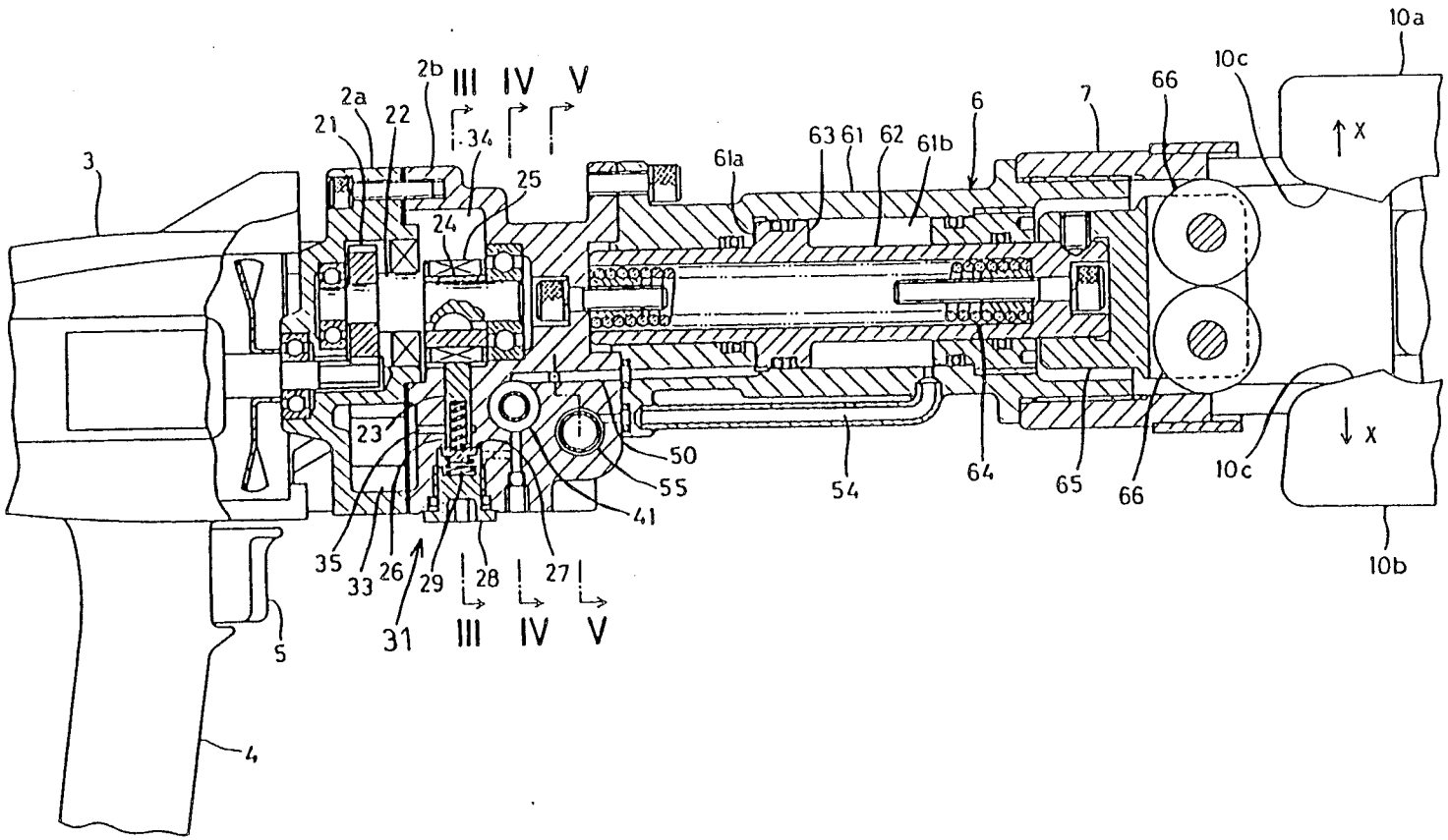
FIG. 2 is a fragmentary elevational view in longitudinal cross section of the device of FIG. 1.
Figure 3:
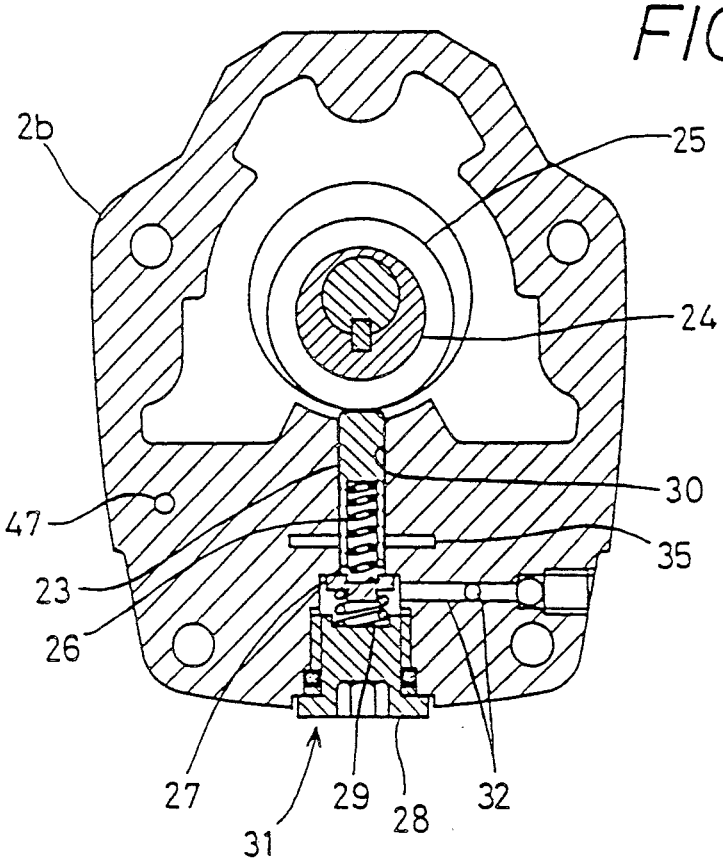
FIG. 3 is a cross sectional view taken along line III—III of FIG. 2.

A pressure relief valve 52 is disposed in connection with a branch line 53 of the feed-discharge passage 50, as shown in FIG. 5. The cylinder body 61 of the single-acting cylinder 6 has a low-pressure chamber 61*b*, as indicated in FIG. 2. This chamber 61*b* communicates with a drain passage 54 which in turn communicates with the oil reservoir 33. The drain passage 54 communicates with an intermediate chamber 55 which receives a rubber bag 56 for accommodating or absorbing a change in the volume of the working fluid in the low-pressure chamber 61*b* due to a movement of a piston 63 of the single-acting cylinder 6. The interior of the rubber bag 56 is exposed to the atmosphere, and the portion of the intermediate chamber 55 outside the rubber bag 56 is used as a variable-volume chamber for storing the fluid fed through the drain passage 54.

Referring back to FIG. 2, a piston rod 62 is formed integrally with the piston 63. The piston rod 62 is biased by a return spring in the form of a tension coil spring 64, toward its fully retracted or home position. The piston rod 62 has a bracket 65 fixed to its front end. The bracket 65 rotatably supports two rollers 66, so that these rollers 66 engage inner tapered surfaces 10*c* of the jaws 10*a*, 10*b* when the piston rod 62 is advanced, thereby moving the rear portions of the jaws 10*a*, 10*b* in opposite directions indicated by arrows X in FIG. 2.

The portable hydraulically operated device 1 constructed as described above may be used to perform a plumbing job for connecting tubes with a coupler, as indicated in FIG. 6, by way of example. In this figure, one of the tubes and the coupler are indicated at 70 and 72, respectively. The coupler 72 has an O-ring 71 received in an annular groove formed in a flanged end portion 72*a*, for fluid-tight connection of the tube 70 to another tube by means of the coupler. In operation, the two jaws 10*a*, 10*b* are manually opened so that the relevant portions of the tube 70 and coupler 72 are located within the clamping portion 12 of the jaws such that the flanged end portion 72*a* engages the annular groove defined by the second clamping surfaces 12*b* of the jaws 10*a*, 10*b*. Then, the operator of the device 1 turns on the on-off switch 5, to start the electric motor 3 to turn on the plunger pump 31. Described in detail, the operation of the motor 3 causes the plunger 23 to be reciprocated by the eccentric cam 24, whereby a pressurized fluid is fed to the valve chamber 41 of the automatic drain valve 40, through the delivery passage 32. When a thrust force based on the delivery pressure of the pump 31, i.e., a thrust force based on the pressure of the fluid in the first fluid chamber 41*a* exceeds a sum of a thrust force based on the pressure in the second fluid chamber 41*b* (pressure in the actuating pressure chamber 61*a* of the cylinder 6) and the biasing force of the primary spring 44, the primary valve member 43 is moved toward the valve seat 46. The secondary valve member 48 is moved with the primary valve member 43 until the coned tip 57 is seated on the valve seat 46. With a further advancing movement of the primary valve member 43, a clearance 73 is formed between the open end of the bore 43*b* of the primary valve member 43 and the tapered portion of the extension 45 of the plug 42, whereby the pressurized fluid from the pump 31 flows through the clearance 73 and is fed into the actuating pressure chamber 61*a* of the single-acting cylinder 6 through the bore 43*b*, communication holes 51 and feed-discharge passage 50. As a result, the piston rod 62 is moved toward the jaws 10*a*, 10*b*, and the rollers 66 force the inner tapered surfaces 10*c* of the jaws 10*a*, 10*b*, thereby pivoting the rear portions of the jaws in the directions X. Consequently, the front portions of the jaws 10*a*, 10*b* which have the clamping portion 12 are pivoted so as to cause the first and second clamping surfaces 12*a*, 12*b* to radially inwardly compress the flanged end portion 72*a* and the adjacent portion of the coupler 72 against the tube 70, whereby the coupler 72 is caulked to the tube 70.

After the clamp jaws 10*a*, 10*b* are closed to complete the caulking operation, the on-off switch 5 is turned off to turn off the electric motor 3, and the hydraulic pump 31 is turned off to stop the delivery of the pressurized fluid. Consequently, the thrust force based on the difference between the pressures in the first and second fluid chambers 41*a* and 41*b* becomes smaller than the biasing force of the primary spring 44. As a result, the primary valve member 43 is retracted by the biasing force of the primary spring 44 toward the plug 42, and the secondary valve member 48 is also retracted away from the valve seat 46. Consequently, the feed-discharge passage 50 is brought into communication with the drain passage 47 through the second fluid chamber 41*b*, whereby the fluid in the actuating pressure chamber 61*a* of the cylinder 6 is discharged into the oil reservoir 33 through the passages 50, 47. Thus, the pressure chamber 61*a* is automatically drained when the pump 31 is turned off. Accordingly, the piston rod 62 is returned by the return spring 64 to its fully retracted position of FIG. 2, with the rollers 66 being spaced away from the inner tapered surfaces 10*c* of the clamp jaws 10*a*, 10*b*, so as to allow the clamping portion 12 to be opened for removing the workpieces 70, 72.

It will be understood from the above description that the piston rod 62 may be readily advanced and retracted by simply operating the on-off switch 5. In particular, the piston rod 62 may be retracted from any desired position or at any time after the piston rod 62 is commanded to be advanced.

The present device which has been described above may be modified as desired. In particular, the arrangement of the automatic drain valve 40 is not limited to that shown in FIG. 4. For example, the secondary spring 49 for biasing the secondary valve member 48 toward the valve seat 46 may be disposed between the primary and secondary valve members 43, 48, as illustrated in FIGS. 7 and 8. In FIG. 7, reference numeral 74 designates a pin driven into the primary valve member 43. Further, the flange portion 48*a* of the secondary valve member 48 may be replaced by any other means for guiding the valve member 48. In the arrangement of FIG. 4, the extension 45 of the plug 42 has the tapered portion for assuring a gradual increase in the amount of the clearance 73 as the primary valve member 43 is advanced toward the valve seat 46. This arrangement provides a relatively large operating stroke of the primary valve member 43, and permits the secondary valve member 48 to be stably seated on the valve seat 46 even when the fluid introduced in the valve chamber 41 is subject to pressure pulsations. However, the extension 45 may be a relatively short cylinder whose end portion has slits or cutouts such as triangular grooves. Alternatively, the end portion of the bore 43*b* of the primary valve member 43 may be tapered for engagement with a relatively short cylinder of the extension 45.

Referring next to FIGS. 9–16, a second embodiment of the present invention will be described.

Figure 9:
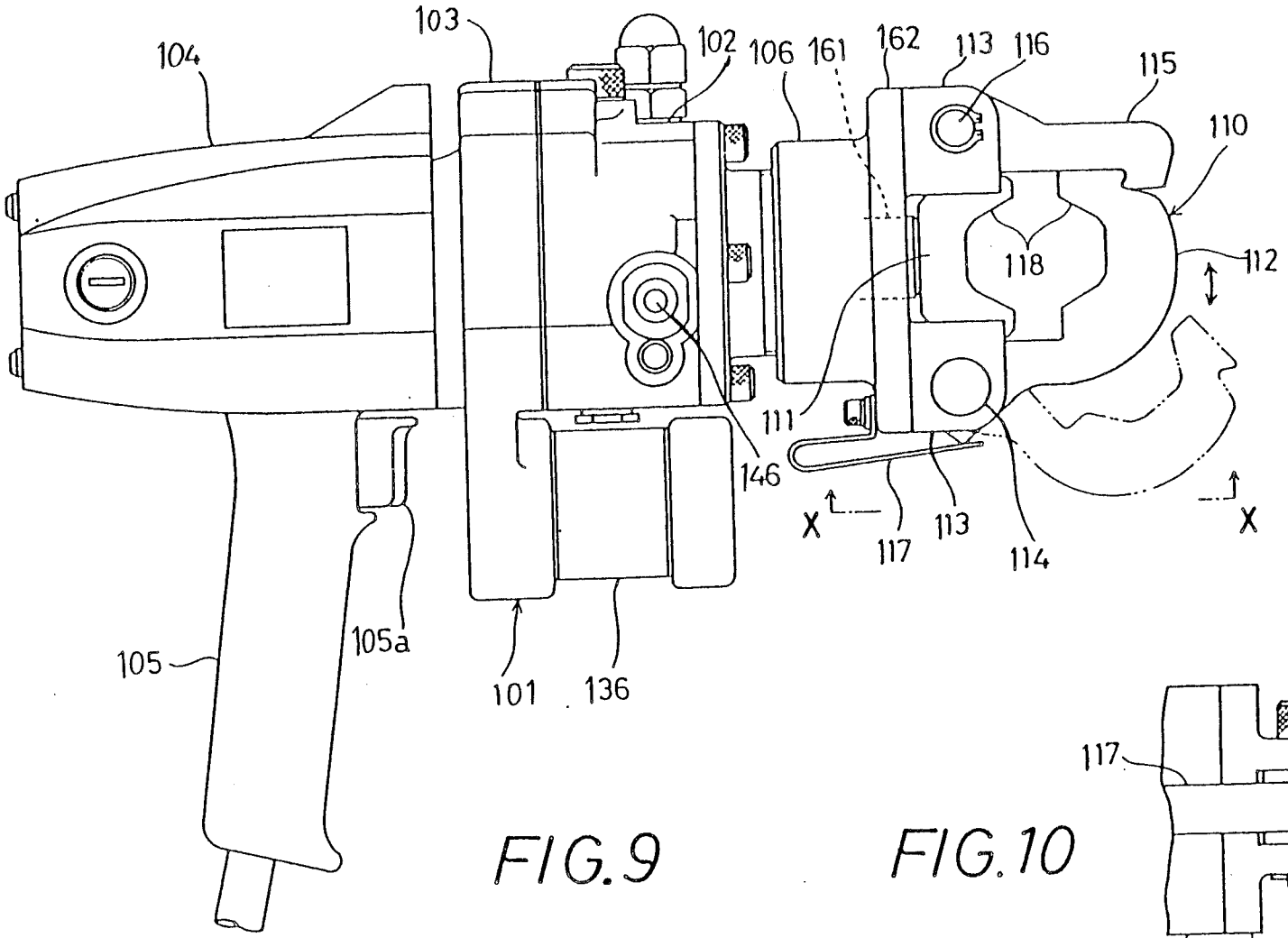
FIG. 9 is a front elevational view showing another embodiment of the portable hydraulically operated device of this invention.
Figure 10:
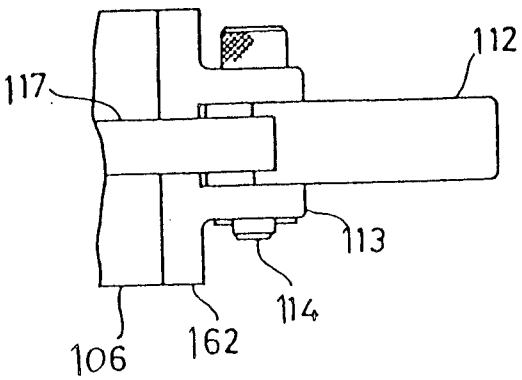
FIG. 10 is a bottom plan view taken in the direction of arrow X in FIG. 9.
Figure 11:
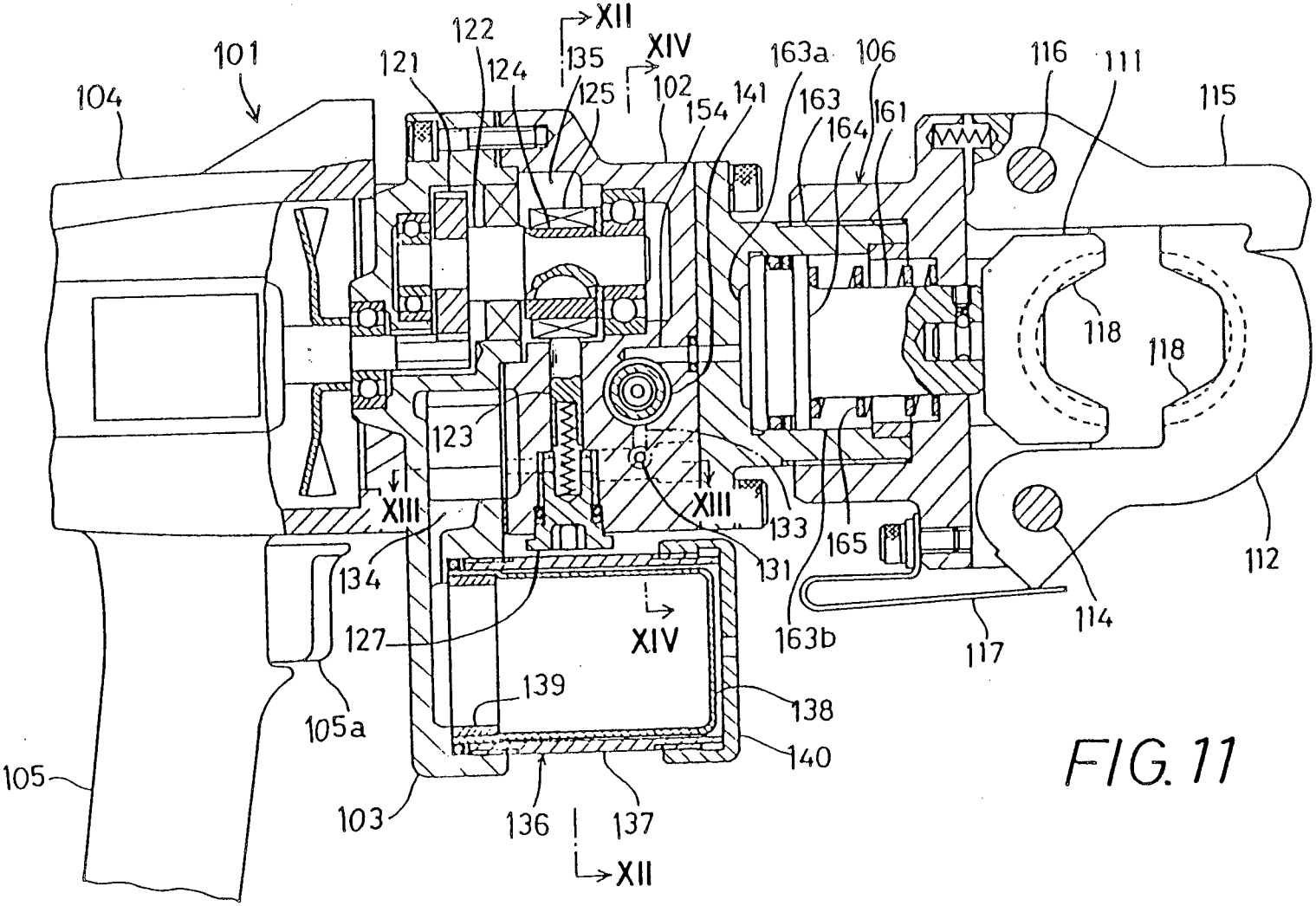
FIG. 11 is a fragmentary elevational view in longitudinal cross section of the device of FIG. 9.
Figure 12:
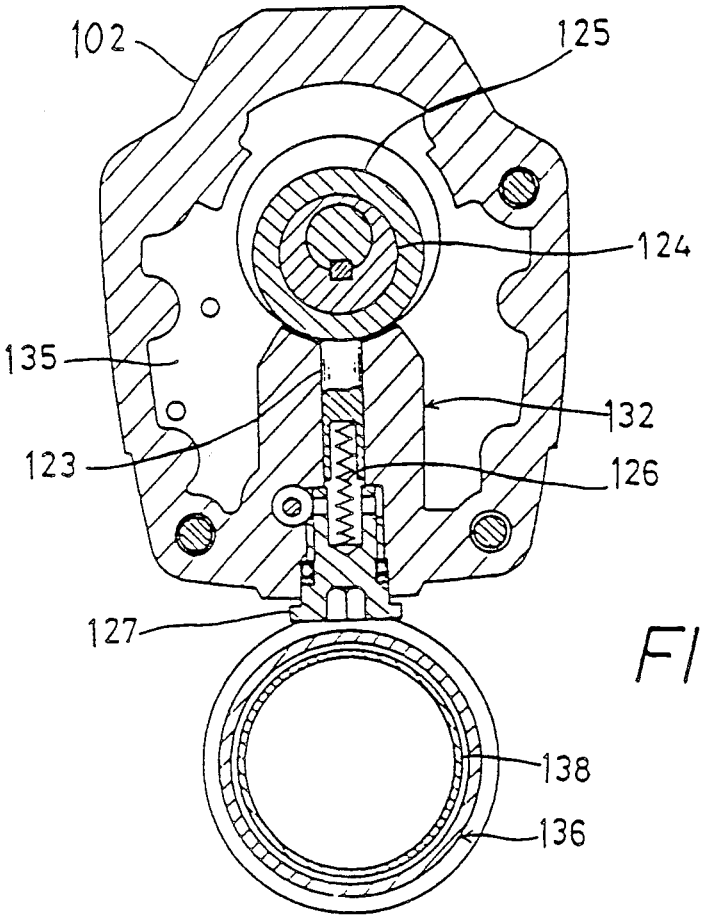
FIG. 12 is a cross sectional view taken along line XII—XII of FIG. 11.
Figure 15:
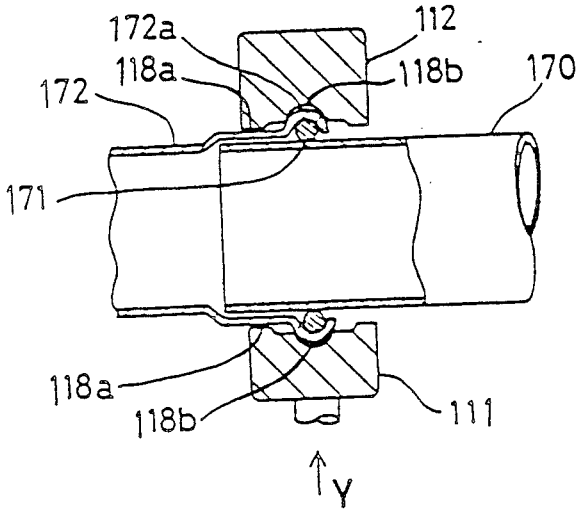
FIG. 15 is a cross sectional view showing clamp jaws of the device of FIG. 9 when the jaws act on a workpiece.

In FIG. 9, a portable hydraulically operated device is generally indicated at 101. The device 101 has a housing 102 accommodating a hydraulic pump 132 (FIG. 12), a casing 103 which is attached to the housing 102 and which accommodates a gear 121 (FIG. 11) and carries a second oil reservoir 136, and an electric motor 104 attached to the casing 103. The motor 104 provided to drive the pump 132 is turned on and off by an operator-controlled on-off switch 105*a* provided on a handle 105. The device 101 further includes a single-acting cylinder 106 attached to the housing 102, and a caulking tool 110 in the form of a movable jaw 111 and a retainer jaw 112. The movable jaw 111 is fixed to the end of a piston rod 161 of the cylinder 106, while the retainer jaw 112 is pivotally supported by a pivot pin 114 provided on a bracket 113 secured to an end plate 162 of the cylinder 106. A detent 115 is pivotally supported by a pivot pin 116 provided on the bracket 113. The detent 115 is engageable with the free end of the retainer jaw 112. The retainer jaw 112 is normally placed in its open position under a biasing action of a sheet spring 117. Each of the jaws 111, 112 has an inner working surface 118 which includes a first caulking portion 118*a* and a second caulking portion 118*b*, as indicated in FIG. 15. In the closed position of the caulking tool 110, the first caulking portions 118*a* of the two jaws 111, 112 cooperate to define a hexagonal shape, while the second caulking portions 118*b* of the two jaws cooperate to define an annular shape.

Figure 13:
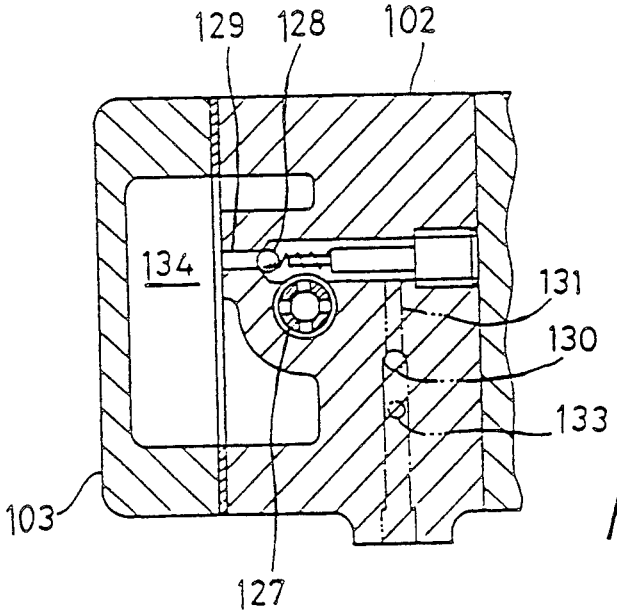
FIG. 13 is a cross sectional view taken along line XIII—XIII of FIG. 11.
Figure 14:
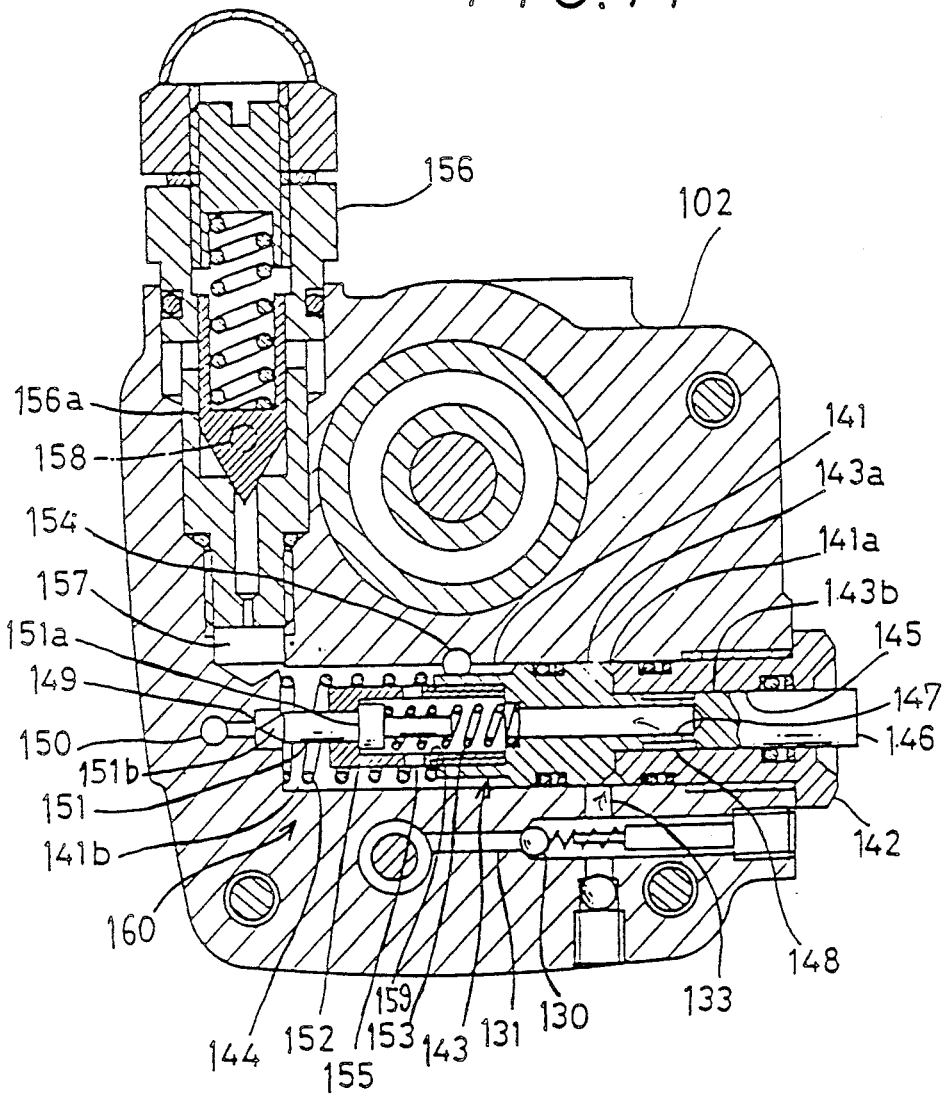
FIG. 14 is a cross sectional view taken along line XIV—XIV of FIG. 11.

The interior construction of the device 101 is shown in FIGS. 11 through 14. The casing 103 cooperates with the housing 102 to rotatably support a drive shaft 122 which is driven by the electric motor 104 through a gear 121. The hydraulic pump 132 includes a plunger 123 slidably supported by the housing 102. The end of the plunger 123 is held in contact with a needle bearing 125, under a biasing action of a compression coil spring 126. The needle bearing 125 is fitted on an eccentric cam 124 fixed to the drive shaft 122. The pre-load of the compression coil spring 126 is set by a plug 127. As shown in FIG. 13, a check valve 128 is provided at a suction port 129 of the pump 132, and a check valve 130 is provided at a delivery port 131 of the pump 132. The check valve 128 is opened when the pump 132 sucks in a working fluid through the suction port 129, while the check valve 130 is opened when the pressurized fluid is delivered through the delivery port 131. The pressurized fluid produced by the pump 132 and delivered through the delivery port 131 is fed through a delivery passage 133 into a valve chamber 141 of an automatic drain valve 160 (FIG. 14). The casing 103 and the housing 102 have respective first oil reservoirs 134, 135 which communicate with each other. The suction port 129 communicates with the oil reservoir 134. The second oil reservoir 136 indicated above is a variable volume chamber which is defined by a rubber bag 138 accommodated in a metallic outer sleeve 137 threaded to the casing 103. The fixed end portion of the rubber bag 138 is forced by a sealing ring 139 against the inner surface of the threaded end portion of the outer sleeve 137. The open end of the outer sleeve 137 opposite to the threaded end is closed by a cap 140. The space between the rubber bag 138 and the outer sleeve and cap 137, 140 is exposed to the atmosphere through an air vent formed through the cap 140, so as to permit the rubber bag 138 to be deformed when the fluid flows into or out of the bag. The second oil reservoir 136 communicates with the first oil reservoir 134.

In the automatic drain valve 160 shown in FIG. 14, the valve chamber 141 is defined by a round hole which is formed in the housing 102 and closed by a plug 142. The delivery passage 133 is open to a first fluid chamber 141*a* of the valve chamber 141 on the side of the plug 142. The valve chamber 141 receives a large-diameter portion 143*a* of a stepped primary valve member 143. The large-diameter portion 143*a* axially slidably engages the inner surface of the valve chamber 141, so as to divide the valve chamber 141 into the first and second fluid chambers 141*a* and 141*b*. The primary valve member 143 further includes a small-diameter portion 143*b* which extends from the large-diameter portion 143*a*. The primary valve member 143 is biased toward the plug 142 (toward the first fluid chamber 141*a*) by a primary spring 144 disposed in the second fluid chamber 141*b* of the valve chamber 141. The small-diameter portion 143*b* of the primary valve member 143 slidably engages a small-diameter through-hole 145 formed through the plug 142. The small-diameter portion 143*b* is longer than the small-diameter through-hole 145, and an outer end face 146 of the portion 143*b* is exposed to the atmosphere.

The primary valve member 143 has a communication passage 147 formed in the radially central portion thereof so as to extend in the axial direction. The communication passage 147 communicates at one end thereof with an annular groove 148 formed in the outer circumferential surface of the small-diameter portion 143*b*. The second fluid chamber 141*b* communicates with the first oil reservoir 134 through a drain passage 150, which is open to the second fluid chamber 141*b*. Around the open end of the drain passage 150, there is formed a valve seat 149 exposed to the second fluid chamber 141*b*. The primary valve member 143 carries a cap 152 screwed thereto. A secondary valve member 151 is axially slidably supported by the cap 152. The secondary valve member 151 has a flange portion 151*a* slidably engaging a bore 159 formed in the cap 152, and extends through the bottom wall of the cap 152 toward the valve seat 149 such that a coned tip 151*b* outside the cap 152 is engageable with the valve seat 149. The secondary valve member 151 is biased toward the valve seat 149 by a secondary spring 153 disposed between the flange portion 151*a* and the primary valve member 143.

The second fluid chamber 141*b* also communicates with an actuating pressure chamber 163*a* of a cylinder body 163 of the single-acting cylinder 106, through a feed-discharge passage 154. The end of the feed-discharge passage 154 which is open to the second fluid chamber 141*b* is not closed by the large-diameter portion 143*a* of the primary valve member 143 even when the valve member 143 is moved to its fully advanced position on the side of the valve seat 149. The cap 152 has communication holes 155 formed through the cylindrical wall thereof. The communication passage 147 in the primary valve member 143 communicates with the second fluid chamber 141*b* through the bore 159 and communication holes 155.

Also shown in FIG. 14 is a relief valve 156 which controls the caulking pressure of the caulking tool 110. The relief valve 156 has an inlet 157 communicating with the second fluid chamber 141*b*, and an outlet 158 communicating with the first oil reservoir 135.

Referring back to FIG. 11, the single-acting cylinder 106 includes a piston rod 161, and a piston 164 which is integral with the piston rod 161 and which divides the bore in the cylinder body 163 into the actuating pressure chamber 163*a* and a low-pressure chamber 163*b*. The piston 164 is biased toward the fully retracted position by a return spring in the form of a compression coil spring 165 disposed in the low-pressure chamber 163*b*.

The portable hydraulically operated device 101 constructed as described above may also be used to perform a caulking operation for connecting two plumbing tubes with a coupler, as indicated in FIG. 15, by way of example. In this figure, one of the tubes and the coupler are indicated at 170 and 172, respectively. The coupler 172 has an O-ring 171 received in an annular groove formed in a flanged end portion 172*a*, for fluid-tight connection of the tube 170 to another tube by means of the coupler 172. In operation, the movable and retainer jaws 111, 112 are first manually opened so that the relevant portions of the tube 170 and coupler 172 are located within the clamping portion 118 of the jaws such that the flanged end portion 172*a* engages the annular groove defined by the second caulking surfaces 118*b* of the jaws 111, 112. Then, the operator of the device 101 turns on the on-off switch 105, to start the electric motor 104 to turn on the plunger pump 132. Described in detail, the operation of the motor 104 causes the plunger 123 to be reciprocated by the eccentric cam 124, whereby a pressurized fluid is fed to the first fluid chamber 141*a* of the automatic drain valve 160, through the delivery passage 133. When a thrust force based on the delivery pressure of the pump 132, i.e., a thrust force based on the pressure of the fluid in the first fluid chamber 141*a* exceeds a sum of a thrust force based on the pressure in the second fluid chamber 141*b* (pressure in the actuating pressure chamber 163*a* of the cylinder 106) and the biasing force of the primary spring 144, the primary valve member 143 is advanced toward the valve seat 149. The secondary valve member 151 is moved with the primary valve member 143 until the coned tip 151*b* is seated on the valve seat 149. With a further advancing movement of the primary valve member 143, the annular groove 148 communicating with the communication passage 147 is brought into communication with the first fluid chamber 141*a*, as indicated at 173 in FIG. 16. Consequently, the pressurized fluid fed into the first fluid chamber 141*a* through the delivery passage 133 flows into the communication passage 147 through the annular groove 148, and is fed into the actuating pressure chamber 163*a* of the single-acting cylinder 106 through the communication holes 155 and feed-discharge passage 154. As a result, the piston rod 161 is advanced toward the caulking tool 110, whereby the movable jaw 111 is moved toward the retainer jaw 112, thereby causing the first and second caulking surfaces 118*a*, 118*b* to radially inwardly compress the flanged end portion 172*a* and the adjacent portion of the coupler 172 against the tube 170, whereby the coupler 172 is caulked to the tube 170. The movement of the primary valve member 143 can be easily confirmed by the operator, since the end face 146 of the small-diameter portion 143*b* is exposed outside the small-diameter through-hole 145 of the plug 142. It is noted that when the movable jaw 111 has reached its stroke end, more precisely, when the pressure in the actuating pressure chamber 163*a* has reached a predetermined level, the relief valve 156 is repeatedly opened and closed at a relatively high frequency with its valve body 156*a* being oscillated, whereby the primary valve member 143 oscillates by a small amount in the axial direction. This oscillation of the primary valve member 143, which indicates the completion of the caulking operation, can also be confirmed by the operator by observing the exposed end face 146 of the small-diameter portion 143*b*, which is positioned outside the plug 142 when the relief valve 156 is opened. In other words, the fact that the pressure in the pressure chamber 163*a* has reached the predetermined level can be confirmed by observing the end face 146 of the small-diameter portion 143*b*. This prevents an incomplete caulking operation, or aids the operator in determining the time when the on-off switch 105*a* can be turned off to terminate the caulking operation.

When the on-off switch 105*a* is turned off upon completion of the caulking operation, the electric motor 104 is turned off, and the hydraulic pump 132 is turned off to stop the delivery of the pressurized fluid. As a result, the primary valve member 143 is retracted by the biasing force of the primary spring 144 toward the plug 142, and the secondary valve member 151 is also retracted away from the valve seat 149. Consequently, the feed-discharge passage 154 is brought into communication with the drain passage 150 through the second fluid chamber 141*b*, whereby the fluid in the actuating pressure chamber 163*a* of the cylinder 106 is discharged into the first oil reservoir 134 through the passages 154, 150. Accordingly, the piston rod 161 is returned with the movable jaw 111 by the return spring 165 to its fully retracted position of FIG. 9, so as to allow the operator to remove the workpieces 170, 172 from between the movable and retainer jaws 111, 112.

It will be understood from the above description that the piston rod 161 may be readily advanced and retracted by simply operating the on-off switch 105*a*. In particular, the piston rod 161 may be retracted from any desired position or at any time after the pump 132 is started.

Figure 16:
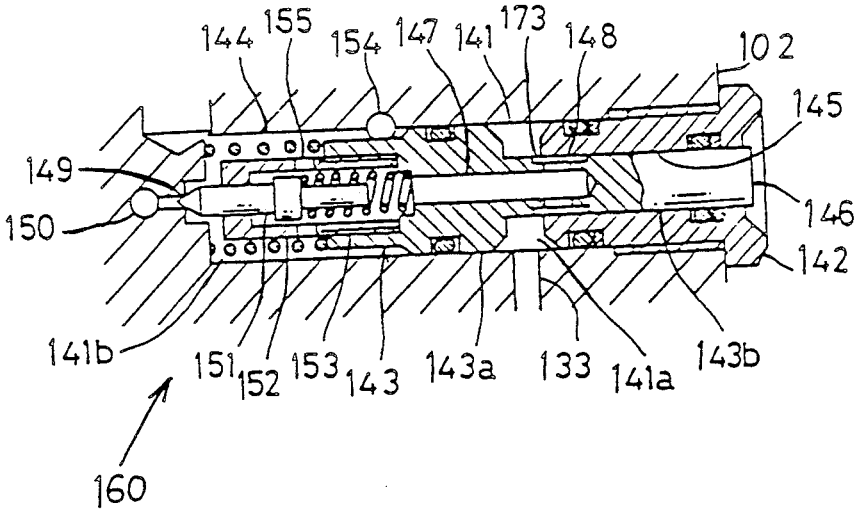
FIG. 16 is a view in cross section showing operated positions of a primary and a secondary valve member used in the device of FIG. 9.
Figure 17:
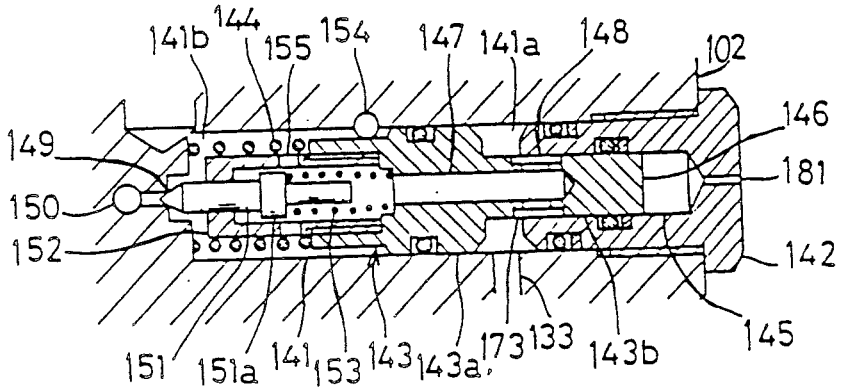
FIGS. 17, 18 and 19 are views corresponding to those of FIG. 16, showing modified forms of the valve members used in the embodiment of FIG. 9.
Figure 18:
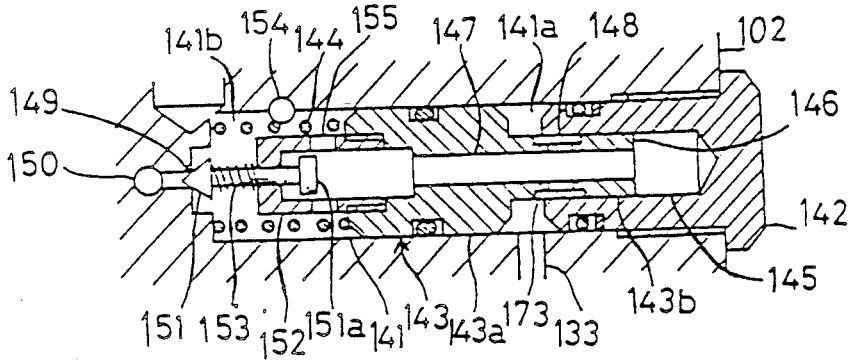
Figure 19:
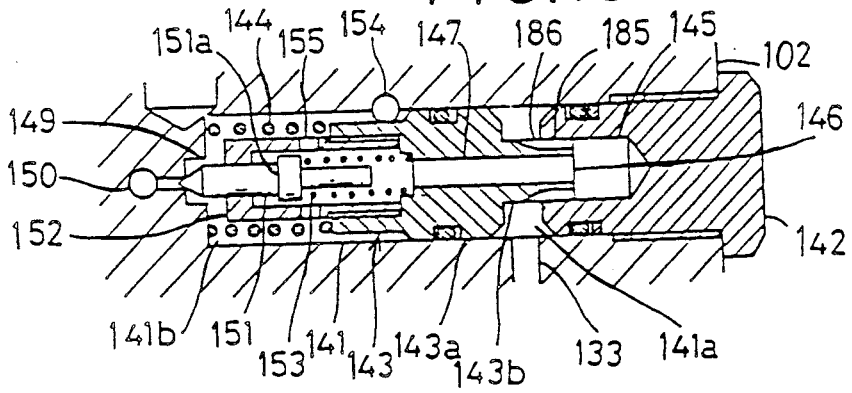

Referring next to FIGS. 17 through 19, there will be described modifications of the automatic drain valve 160 used in the preceding embodiment of FIGS. 9-16. The same reference numerals as used in FIG. 16 are used in FIGS. 17-19 to identify the corresponding components, which will not be described.

In the automatic drain valve shown in FIG. 17, the small-diameter hole 145 is a blind hole formed in the plug 142 and is not directly exposed to the atmosphere. Namely, the hole 145 has a comparatively small length and communicates with the atmosphere through an air vent 181. In this case, the small-diameter portion 143*b* of the primary valve member 143 which is received in the hole 145 has a comparatively small length, and its movement cannot be observed by the operator.

In the automatic drain valve shown in FIG. 18, the secondary spring 153 for biasing the secondary valve member 151 toward the valve seat 149 is disposed in the second fluid chamber 141*b*, i.e., outside the cap 152. Further, the communication passage 147 is formed through the small-diameter portion 143*b* so that the passage 147 is open in the end face 146 and exposed to the small-diameter blind hole 145 formed in the plug 142. In this arrangement, the pressurized fluid is introduced also into the bottom portion of the blind hole 145.

In the automatic drain valve shown in FIG. 19, the communication passage 147 is formed through the small-diameter portion 143*b* so that the passage 147 is open in the end face 146, as in the embodiment of FIG. 18. The end portion of the small-diameter portion 143*b* is formed with cutouts 185 in the form of slits formed in the outer circumferential surface such that the slits are spaced from each other in the circumferential direction. In this arrangement, the first fluid chamber 141*a* is brought into communication with the bottom portion of the blind hole 145 through the cutouts 185, as indicated at 186, when the primary valve member 143 is advanced toward the valve seat 149 with the pressurized fluid applied to the first fluid chamber 141*a*. As a result, the fluid is introduced into the communication passage 147 through the cutouts 185 and the bottom portion of the blind hole 145. While the end portion of the small-diameter portion 143*b* has the cutouts 185 as described above, the end portion may be tapered or stepped so that the first fluid chamber 141*a* may communicate with the blind hole 145 and the communication passage 147 when the primary valve member 143 is advanced.

While the secondary valve member 151 used in the embodiments of FIGS. 16-19 is a needle valve type, it may be replaced by a ball-type or other type of valve. Further, the flange portion 151*a* may be replaced by other guiding means. In the embodiment of FIGS. 9-16, the low-pressure chamber 163*b* is exposed to the atmosphere, and the second oil reservoir 136 is provided to absorb a change in the amount of the fluid due to the movement of the piston rod 161. However, the second oil reservoir 136 may be eliminated. In this case, the low-pressure chamber 163*b* is connected to the first oil reservoir 134 or 135 through a suitable low-pressure line, so that the chamber 163*b* is charged with the fluid from the reservoir 134, 135. The single-acting cylinder 106 may use a plunger piston which also serves as the piston rod, in place of the integrally formed piston rod 161 and piston 164 which have different diameters.

The caulking tool 110 having the movable and retainer jaws 111, 112 may be replaced by a caulking tool which is operated directly by the advancing movement of the piston rod 161, or by means of rollers which are moved by the piston rod 161 for operating the caulking tool, as in the first embodiment of FIGS. 1-6.

Referring to FIGS. 20-28, a further embodiment of the present invention will be described.

Figure 20:
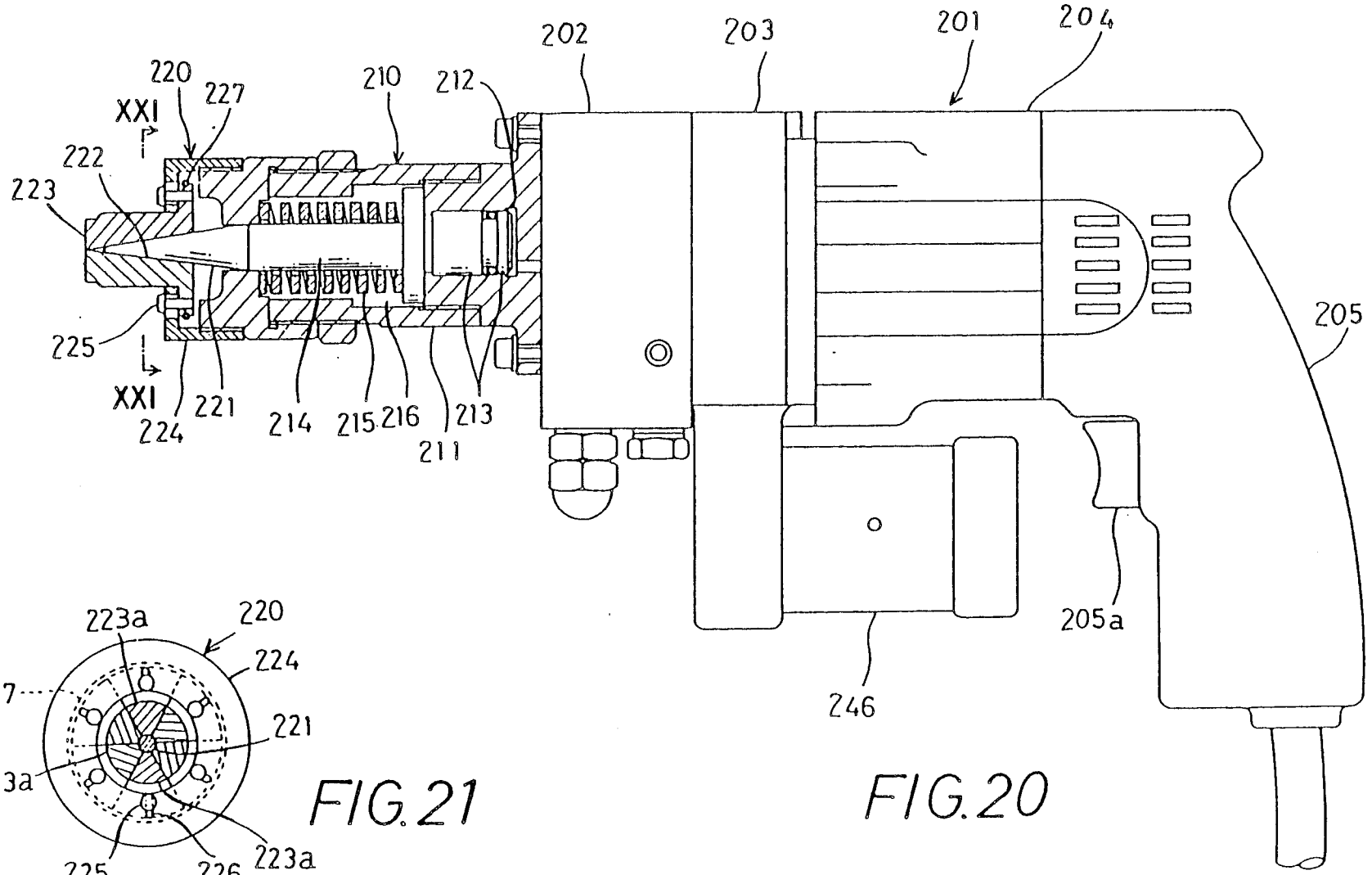
FIG. 20 is a front elevational view partly in cross section of a further embodiment of the present invention.

In FIG. 20, a portable hydraulically operated device adapted to expand a tube is indicated generally at 201. Like the devices 1 and 101 of the preceding embodiments, the device 201 includes a housing 202, a casing 203, an electric motor 204 for driving a plunger pump 242, and a single-acting cylinder 210. The motor 204 is controlled by an operator-controlled on-off switch 205*a* provided on a handle 205. The cylinder 210 has a cylinder body 211 secured to the housing 202. In the cylinder body 211, there are received a piston 213 and a piston rod 214 integral with the piston 213, so as to define an actuating pressure chamber 212 on the side of the piston 213, and a low-pressure chamber 216 on the side of the piston rod 214. The low-pressure chamber 216 is exposed to the atmosphere. The piston 213 is biased by a compression coil spring 215 toward its fully retracted position.

Figure 21:
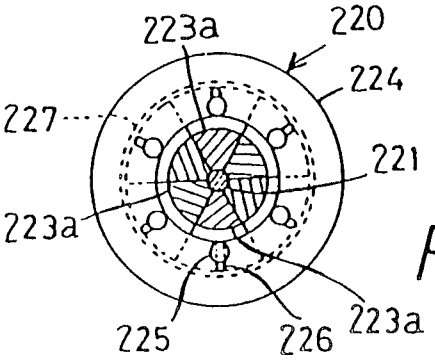
FIG. 21 is a cross sectional view taken along line XXI—XXI of FIG. 20.

Reference numeral 220 denotes an expanding tool 220 attached to the free end of the single-acting cylinder 210. As shown in FIG. 21, the tool 220 includes an expansible collet 223 consisting of six segments 223*a* which are arranged so as to form a cylinder and which cooperate with each other to define a tapered inner surface 222. The expanding tool 220 also includes a cup-shaped retainer 224 threaded to the end of the cylinder body 211. The retainer 224 supports the segments 223*a* of the collet 223 such that the segments 223*a* are movable in the radial direction of the collet 223 or retainer 224. More specifically, each of the segments 223*a* has a pin 225 fixed thereto, while the retainer 224 has six guide slots 226 engaging the pins 225. The segments 223*a* are biased by a tension spring 227 in the radial direction of the collet 223 toward the center of the collet. The piston rod 214 has a coned tip 221 which is engageable with the tapered inner surface 222 of the expansible collet 223.

Figure 22:
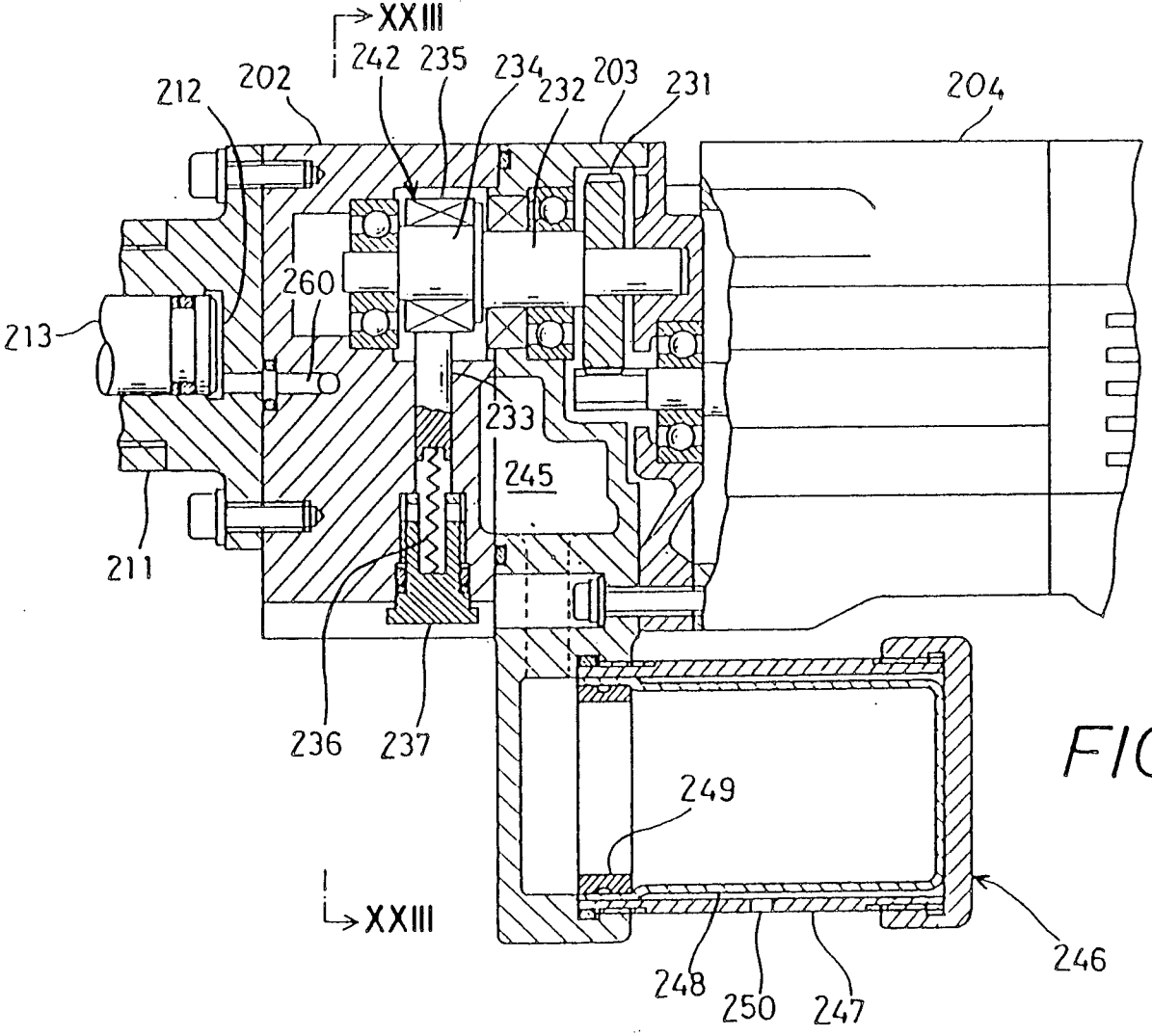
FIG. 22 is a fragmentary elevational view partly in longitudinal cross section of the device of FIG. 20.
Figure 23:
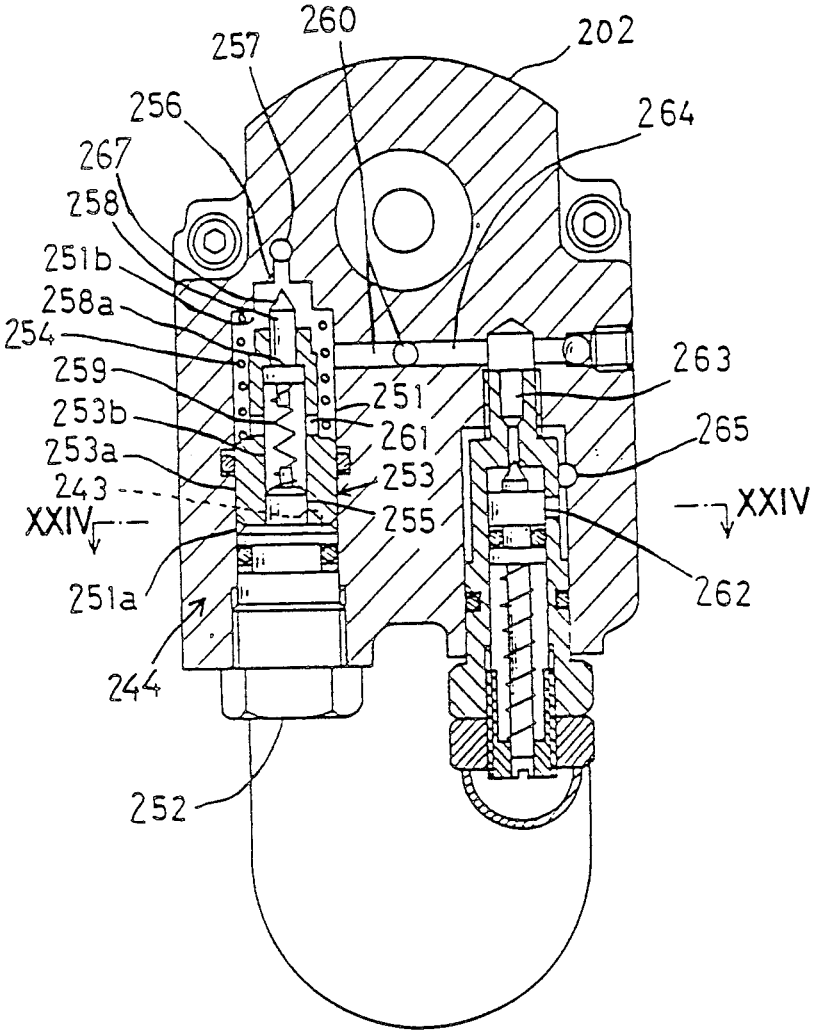
FIG. 23 is a cross sectional view taken along line XXIII—XXIII of FIG. 22.
Figure 24:
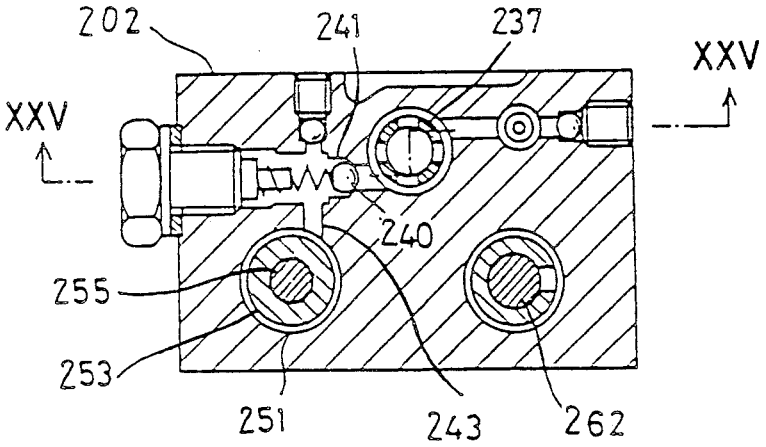
FIG. 24 is a cross sectional view taken along line XXIV—XXIV of FIG. 23.
Figure 25:
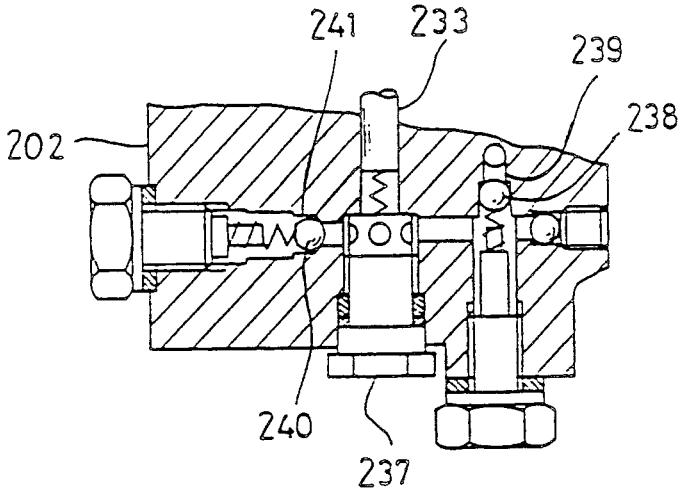
FIG. 25 is a cross sectional view taken along line XXV—XXV of FIG. 24.

The interior construction of the present hydraulically operated device 201 is shown in detail in FIGS. 22-25. In the housing 202 and casing 203, a drive shaft 232 driven by the electric motor 204 through a gear 231 is rotatably supported. The housing 202 slidably supports a plunger 233 of a plunger pump 242 (FIG. 22). The head of the plunger 233 is held in contact with a needle bearing 235, under the biasing action of a compression coil spring 236. The needle bearing 235 is fitted on an eccentric cam 234 fixed to the drive shaft 232. The pre-load of the spring 236 is set by a plug 237. As shown in FIG. 25, a check valve 238 is provided at a suction port 239 of the pump 242, and a check valve 240 is provided at a delivery port 241 of the pump 242. The check valve 238 is opened when the pump 242 sucks in a working fluid through the suction port 239, while the check valve 240 is opened when the pressurized fluid is delivered through the delivery port 241. The pressurized fluid produced by the pump 242 and delivered through the delivery port 241 is fed through a delivery passage 243 into a valve chamber 251 of an automatic drain valve 244 (FIG. 23). The casing 203 has a first oil reservoir 245 which communicates with the suction port 239. The casing 203 carries a second oil reservoir 246 whose volume is variable. The second oil reservoir 246 is defined by a rubber bag 248 accommodated in a metallic outer sleeve 247 threaded to the casing 203. The fixed end portion of the rubber bag 248 is forced by a sealing ring 249 against the inner surface of the threaded end portion of the outer sleeve 247. The second oil reservoir 246 communicates with the first oil reservoir 245, and is filled with the fluid.

In the automatic drain valve 244 shown in FIG. 23, the valve chamber 251 is defined by a round hole which is formed in the housing 202 and closed by a plug 252. The delivery passage 243 is open to a first fluid chamber 251*a* of the valve chamber 251 on the side of the plug 252. The valve chamber 251 receives a stepped primary valve member 253, which has a flange portion 253*a* axially slidably engaging the inner surface of the valve chamber 251, so as to divide the valve chamber 251 into the first and second fluid chambers 251*a* and 251*b*. The primary valve member 253 is biased toward the plug 252 (toward the first fluid chamber 251*a*) by a primary spring 254 disposed in the second fluid chamber 251*b*.

The plug 252 has an extension 255 which is engageable with the corresponding end portion of a bore 253*b* formed in the primary valve member 253. The second fluid chamber 251*b* communicates with the first oil reservoir 245 through a drain passage 257, which is open to the second fluid chamber 251*b*. Around the open end of the drain passage 257, there is formed a valve seat 256 exposed to the second fluid chamber 251*b*. A secondary valve member 258 is axially slidably supported by the primary valve member 253. The secondary valve member 258 has a flange portion 258*a* slidably engaging the bore 253*b* formed in the primary valve member 253, and extends through the bottom wall of the member 253 toward the valve seat 256 such that a coned tip 267 outside the primary valve member 253 is engageable with the valve seat 256. The secondary valve member 258 is biased toward the valve seat 256 by a secondary spring 259 disposed between the flange portion 258*a* and the extension 255 of the plug 252.

The second fluid chamber 251*b* also communicates with an actuating pressure chamber 212 of the cylinder body 211 of the single-acting cylinder 210, through a feed-discharge passage 260. The end of the feed-discharge passage 260 which is open to the second fluid chamber 251*b* is not closed by the large-diameter portion 253*a* of the primary valve member 253 even when the valve member 253 is moved to its fully advanced position on the side of the valve seat 256. The primary valve member 253 has communication holes 261 formed through the cylindrical wall thereof. The bore 253*b* in the primary valve member 253 communicates with the second fluid chamber 251*b* through the communication holes 261.

Also shown in FIG. 23 is a relief valve 262 which has an inlet 263 connected to a branch line 264 which communicates with the feed-discharge passage 260, and further has an outlet 265 communicating with the first oil reservoir 245.

Figure 28:
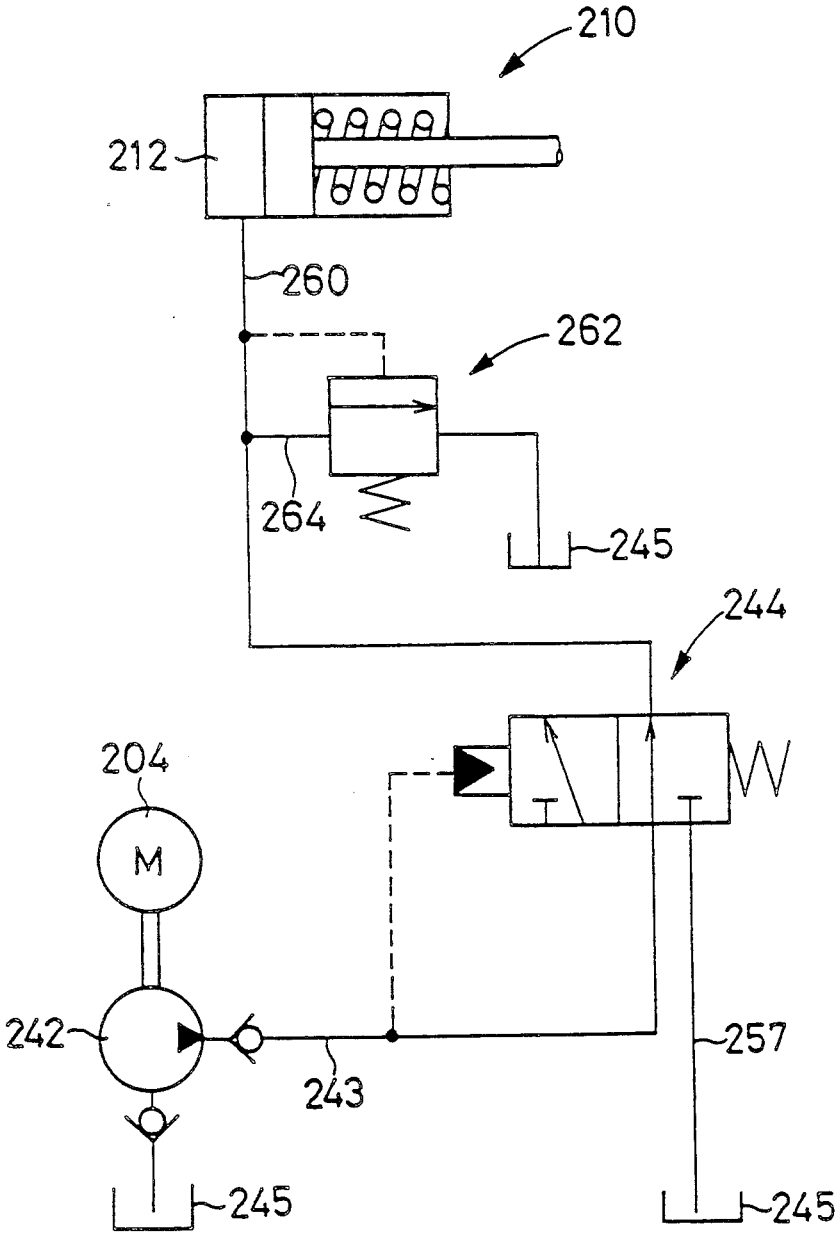
FIG. 28 is a schematic diagram illustrating a hydraulic circuit arrangement of the device of FIG. 20.

A hydraulic circuit for the present portable hydraulically operated device 201 is schematically illustrated in FIG. 28, in which the plunger pump 242 is connected to the actuating pressure chamber 212 of the single-acting cylinder 210, through the automatic drain valve 244 whose second fluid chamber 251*b* communicates with the first oil reservoir 245 through the drain passage 257 when the coned tip 267 of the secondary valve member 258 is not seated on the valve seat 256, that is, when the pump 242 is turned off. The pressure chamber 212 is connected to the relief valve 262 whose outlet 265 communicates with the reservoir 245. It is noted that the hydraulic circuits for the hydraulically operated devices 1 and 101 of the embodiments of FIGS. 1 and 9 are substantially the same as that shown in FIG. 28.

The portable hydraulically operated device 201 of the embodiment of FIGS. 20–26 constructed as described above may be used to perform an operation for expanding the end portion of a plumbing tube 270, as indicated in FIGS. 27(*a*) and 27(*b*), by way of example. Initially, the expansible collet 223 in the contracted position is positioned in the end portion of the tube 270, as indicated in FIG. 27(*a*). That is, the collet 223 is positioned in the tube 270 while the piston rod 214 is placed in the fully retracted position. Then, the operator of the device 201 turns on the on-off switch 205*a*, to start the electric motor 204 to turn on the plunger pump 242. Described in detail, the operation of the motor 204 causes the plunger 233 to be reciprocated by the eccentric cam 234, whereby a pressurized fluid is fed to the first fluid chamber 251*a* of the automatic drain valve 244, through the delivery passage 243. When a thrust force based on the delivery pressure of the pump 242, i.e., a thrust force based on the pressure of the fluid in the first fluid chamber 251*a* exceeds a sum of a thrust force based on the pressure in the second fluid chamber 251*b* (pressure in the actuating pressure chamber 212 of the cylinder 210) and the biasing force of the primary spring 254, the primary valve member 253 is advanced toward the valve seat 256. The secondary valve member 258 is moved with the primary valve member 253 until the coned tip 267 is seated on the valve seat 256. With a further advancing movement of the primary valve member 253, a clearance 266 is formed between the open end of the primary valve member 253 and the extension 255 of the plug 252, whereby the first fluid chamber 251*a* is brought into communication with the bore 253*b* through the clearance 266, as indicated in FIG. 26. Consequently, the pressurized fluid fed into the first fluid chamber 251*a* through the delivery passage 243 flows into the bore 253*b* through the clearance 266, and is fed into the actuating pressure chamber 212 of the single-acting cylinder 210 through the communication holes 261 and feed-discharge passage 260. As a result, the piston rod 214 is advanced toward the expanding tool 220, whereby the coned tip 221 is slidably forced into the tapered inner surface 222 of the expansible collet 223. Accordingly, the segments 223*a* of the collet 223 are radially outwardly moved against the inner surface of the end portion of the tube 270. In this manner, the end portion of the tube 270 is radially outwardly expanded.

When the expanding movement of the collet 223 is completed, the on-off switch 205*a* is turned off to turn off the electric motor 204, and the hydraulic pump 242 is turned off to stop the delivery of the pressurized fluid. As a result, the primary valve member 253 is retracted by the biasing force of the primary spring 254 toward the extension 255, and the secondary valve member 258 is also retracted away from the valve seat 256. Consequently, the feed-discharge passage 260 is brought into communication with the drain passage 257 through the second fluid chamber 251*b*, whereby the fluid in the actuating pressure chamber 212 of the cylinder 210 is discharged into the first oil reservoir 245 through the passages 260, 257. Accordingly, the piston rod 214 is returned with the coned tip 221 by the return spring 215 to its fully retracted position of FIG. 27(*a*), so as to allow the operator to remove the workpiece 270 from the collet 223 placed in the contracted position.

In the present embodiment, too, the piston rod 214 may be readily retracted by simply turning off the on-off switch 205*a* at any time after the advancing movement of the piston rod 214 is commenced.

The secondary valve member 258 may be modified as needed, and the secondary spring 259 may be disposed between the primary and secondary valve members 253, 258. Further, the single-acting cylinder 210 may be modified provided that the piston rod is formed with the coned tip 221 or provided with a member having a tapered outer surface engageable with the tapered inner surface 222 of the collet 223.

A still further embodiment of the present invention will be described by reference to FIG. 29 through FIG. 35.

Figure 30:
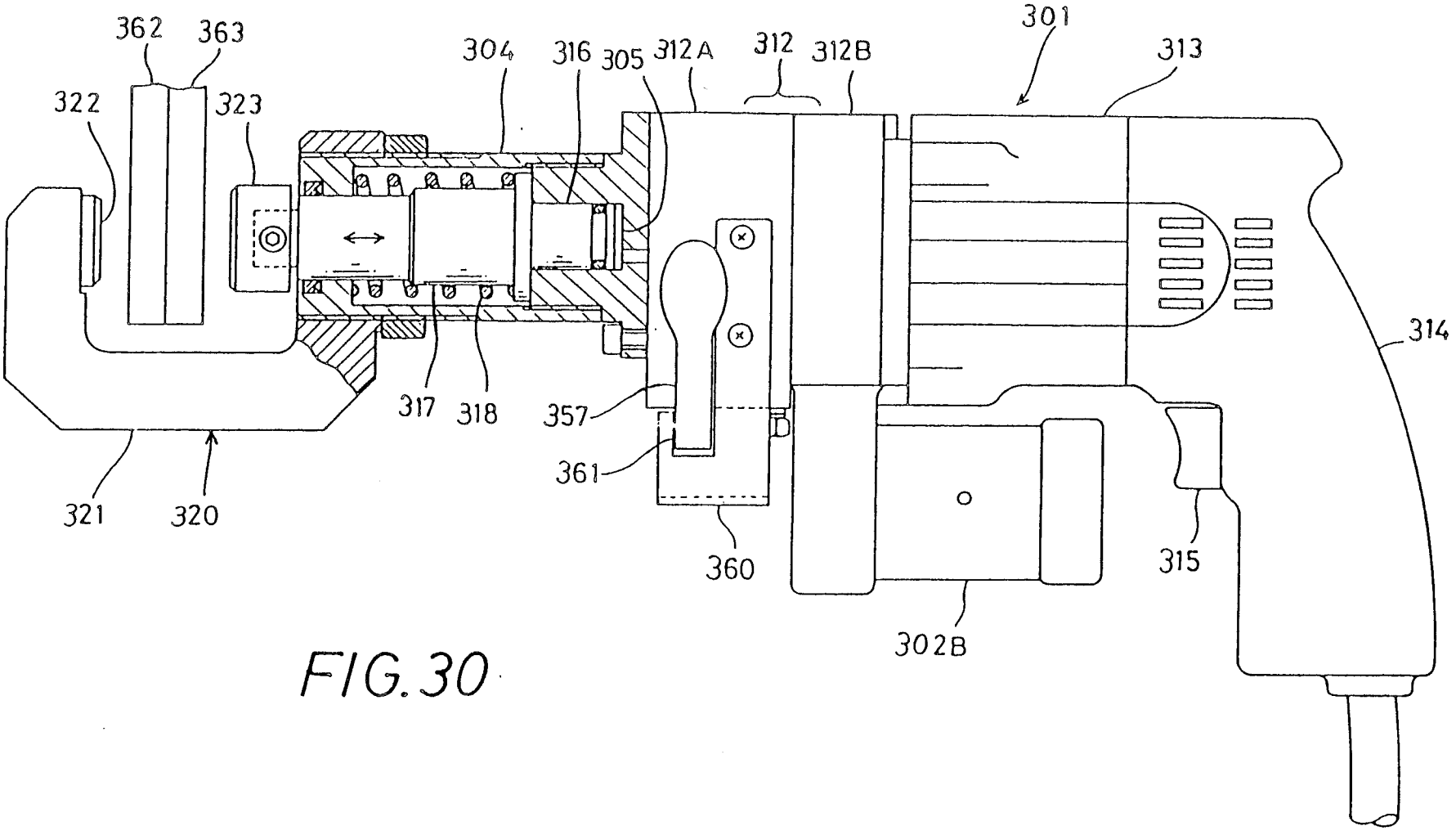
FIG. 30 is a front elevational view partly in cross section of the device of FIG. 29.

The portable hydraulically operated device according to this embodiment of the invention is indicated generally at 301 in FIG. 30. The device 301 incorporates a hydraulic circuit schematically illustrated in FIG. 29, wherein a hydraulic pump 303 whose suction port is connected to a reservoir 302 delivers a pressurized fluid to an actuating pressure chamber 305 of a single-acting cylinder 304, through a delivery passage 306. As described below, the reservoir 302 consists of a first reservoir 302A and a second reservoir 302B. A relief valve 307 is connected to the delivery passage 306. A check valve 308 is provided in a portion of the delivery passage 306 between the pressure chamber 305 and the point of connection of the relief valve 307 to the delivery passage 306. A drain passage 309 is connected to a portion of the delivery passage 306 between pressure chamber 305 and the check valve 308. The drain passage 309 communicates with a manually operated shut-off valve 310 for discharging the pressurized fluid from the pressure chamber 305 into the reservoir 302.

The present hydraulically operated device 301 has a casing 312 which consists of a first casing portion 312A incorporating the pump 303, and a second casing portion 312B secured to the first casing portion 312A. The second casing portion 312B has the first reservoir 302A formed therein, and carries the second reservoir 302B secured thereto. The pump 303 is driven by an electric motor 313 which is attached to the second casing portion 312B. The motor 313 is controlled by an operator-controlled on-off switch 315 provided on a handle 314 of the portable device 301.

The single-acting cylinder 304 is secured to the first casing portion 312A, and has a piston 316 and a piston rod 317 integral with the piston 316. The piston and piston rod 316, 317 are biased by a compression coil spring 318 toward the fully retracted position. The device 301 is provided with a clamping tool 320, which includes a generally U-shaped clamp arm 321 threaded to the cylinder 304. This clamp arm 321 carries a stationary pad 322 fixed thereto in facing relation with the end face of the cylinder 304. The clamping tool 320 further includes a movable pad 323 which is secured to the end of the piston rod 317, in aligned relation with the stationary pad 322.

The interior construction of the present hydraulically operated device 301 is shown in FIGS. 31–35. The first reservoir 302A is defined by a recess 331 which is formed in the second casing portion 312B and which is closed by a recessed end face of the first casing portion 312A. The variable-volume second reservoir 302B retained by the second casing portion 312B communicates with the first reservoir 302A. Thus, the first and second reservoirs 302A, 302B constitute the reservoir 302 shown in FIG. 29. The second reservoir 302B has an outer sleeve 332 threaded to the second casing portion 312B, and a rubber bag 333 received in the sleeve 332. The rubber bag 333 is fixed in position at its open end portion by a sealing ring 334. The first and second reservoirs 302A, 302B are filled with the working fluid.

Figure 34:
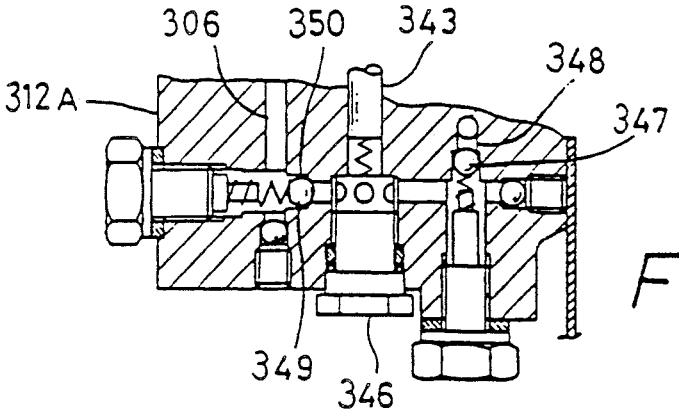
FIG. 34 is a cross sectional view taken along line XXXIV—XXXIV of FIG. 33.
Figure 35:
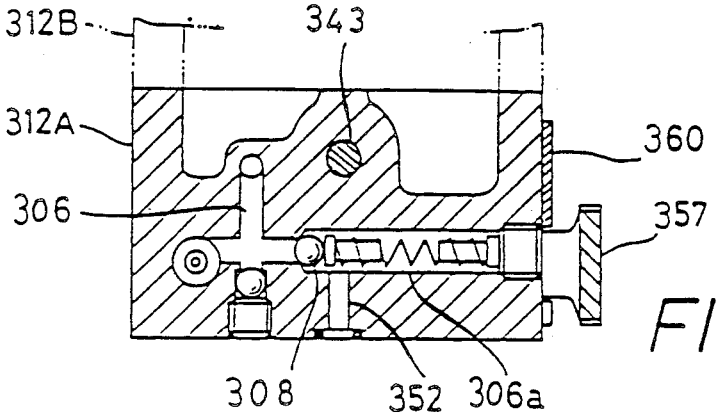
FIG. 35 is a cross sectional view taken along line XXXV—XXXV of FIG. 32.
Figure 36:
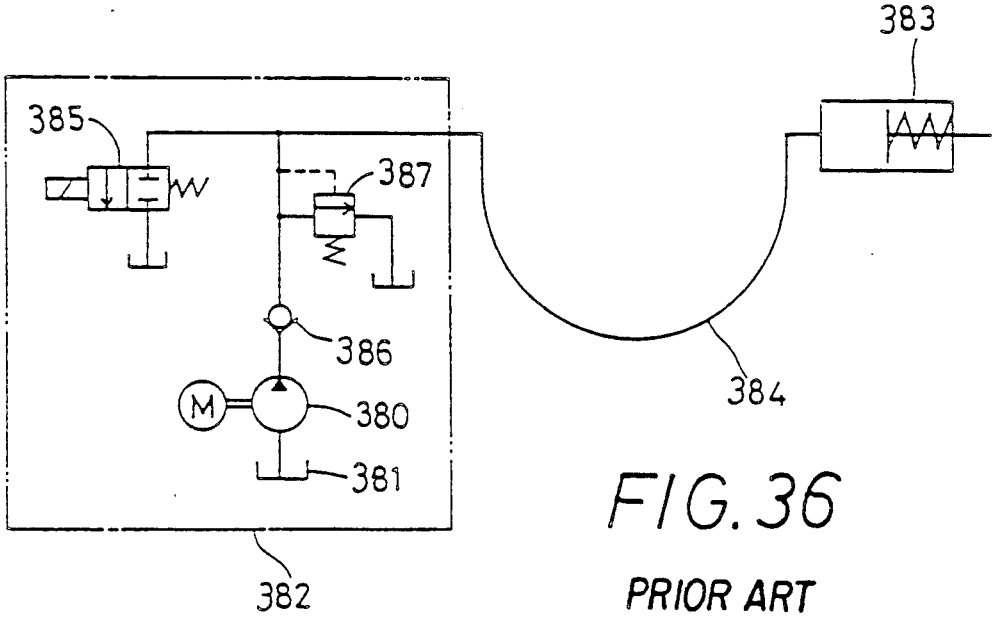
FIG. 36 PRIOR ART
FIG. 36 is a diagram showing a hydraulic circuit used for a known portable hydraulically operated device.

The hydraulic pump 303 incorporated in the first casing portion 312A is a plunger type pump which includes a plunger 343 whose head is held in sliding contact with a needle bearing 342 by a compression coil spring 344. The needle bearing 342 is fitted on an eccentric portion 341*a* of a drive shaft 341 which is rotatably supported by the casing 312. The drive shaft 341 is rotated by the electric motor 313 through a gear 345. The pre-load of the spring 344 is adjustable by a plug 346. As shown in FIG. 34, a check valve 347 is provided at a suction port 348 of the pump 303, while a check valve 349 is provided at a delivery port 350 of the pump 303. The delivery passage 306 is formed through the first casing portion 312A, so as to feed the pressurized fluid from the delivery port 350 of the pump 303 to a feed-discharge port 352 (FIGS. 32 and 35) communicating with the actuating pressure chamber 305 of the cylinder 304.

Figure 32:
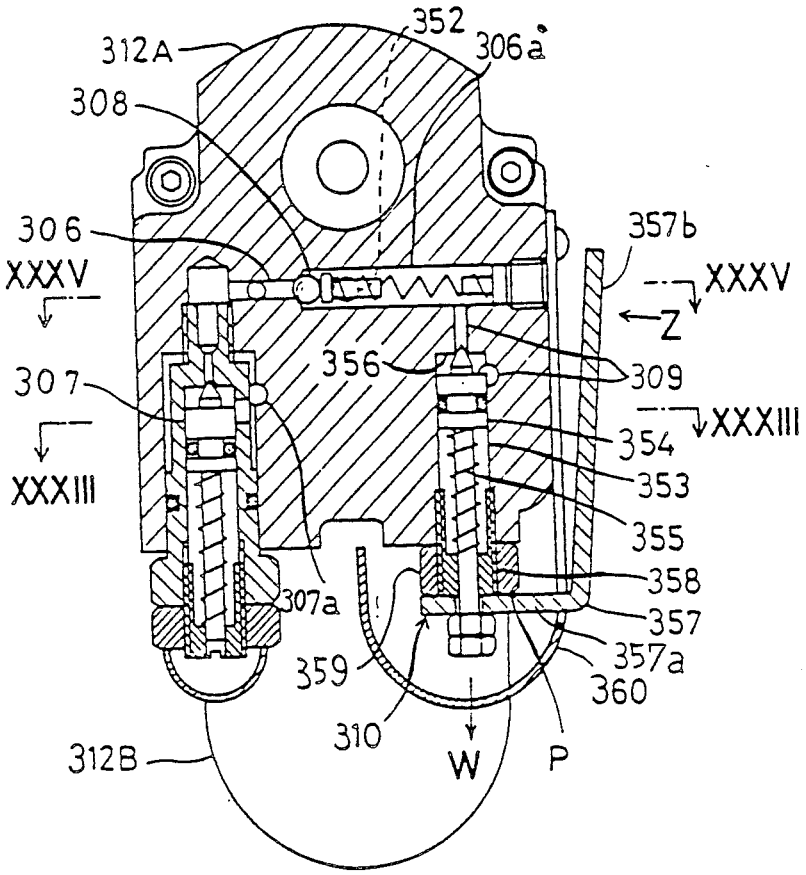
FIG. 32 is a cross sectional view taken along line XXXII—XXXII of FIG. 31.
Figure 33:
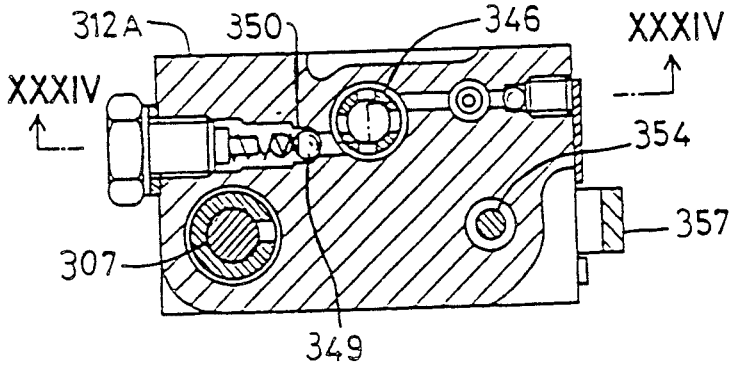
FIG. 33 is a cross sectional view taken along line XXXIII—XXXIII of FIG. 32.

As shown in FIG. 32, the delivery passage 306 is provided with the relief valve 307 and check valve 308 indicated above. The check valve 308 is disposed between the relief valve 307 and the feed-discharge port 352. The relief valve 307 has a drain port 307*a* communicating with the first reservoir 302A. When the relief valve 307 is operated, the pressurized fluid discharged from the cylinder 304 is returned to the first reservoir 302A. The check valve 308 is received in a large-diameter portion 306*a* of the delivery passage 306 which communicates with the feed-discharge port 352. The drain passage 309 indicated above is connected to the large-diameter portion 306*a* of the passage 306. In a portion of the drain passage 309 near the large-diameter portion 306*a* of the delivery passage 306, there is disposed the manually operated shut-off valve 310 indicated above. This shut-off valve 310 includes a valve spool 354 slidably received in a valve hole 353. The spool 354 is biased by a compression coil spring 355 so that the coned tip of the spool 354 is seated on a valve seat 356. One end of the spring 355 is seated on a spring seat 358 which partially defines the valve hole 353. The seat 358 is retained by a nut 359 threaded thereto. The valve spool 354 extends through the spring seat 358 and the nut 359. The shut-off valve 310 is provided with a generally L-shaped operating lever 357 which has a relatively short actuating portion 357*a* and a relatively long operating portion 357*b*. The valve spool 354 extends through the actuating portion 357*a* of the lever 357 such that the actuating portion 357*a* is disposed between the nut 359 and the end of the spool 354 remote from the coned tip. A guide plate 360 is secured to the first casing portion 312A, and the proximal end of the actuating portion 357*a* engages a cutout 361 formed through the guide plate 360 so that the lever 357 is pivotable about a point P at the periphery of the end face of the nut 359, as indicated in FIG. 32. The guide plate 360 prevents the lever 357 from pivoting about the spool 354. When the lever 357 is pressed at the operating portion 357*b* in the direction indicated by arrow Z in FIG. 32, the valve spool 354 is moved in the direction from the valve seat 356 toward the spring seat 358, whereby the coned tip of the spool 354 is separated from the valve seat 356.

The present portable hydraulically operated device 301 may be used for clamping together two workpieces to be welded, for example. In FIG. 30, the workpieces are indicated at 362, 363. In operation, the device 301 is hand-held or fixed on a worktable, and the on-off switch 315 is turned on to start the electric motor 313. The drive shaft 341 is rotated to reciprocate the plunger 343, whereby the pressurized fluid delivered from the pump 303 is fed into the pressure chamber 305 of the cylinder 304 through the delivery passage 306. As a result, the piston 316 and the piston rod 317 are advanced to advance the movable pad 323, whereby the two workpieces 362, 363 are clamped together by the movable and stationary pads 323, 322. When the clamping pressure reaches a certain level, the relief valve 307 is operated. At this time, the on-off switch 315 is turned off to stop the motor 313 and pump 303. However, the pressure in the pressure chamber 305 of the cylinder 304 is maintained by the check valve 308 and the shut-off valve 310 in the closed position. Namely, the fluid in the pressure chamber 305 is prevented from returning to the reservoir 302, so that the piston rod 317 is held in the advanced position for holding the workpieces 362, 363 in the clamped state, during a welding operation on the workpieces. After the welding operation is completed, the operating lever 357 is operated by the operator, and the shut-off valve 310 is operated with the valve spool 354 moved to its open position allowing the fluid to return to the reservoir 302 through the drain passage 309, while the piston 316 and piston rod 317 are returned to the fully retracted position of FIG. 30 under the biasing force of the return spring 318. Consequently, the welded workpieces 362, 363 are released from the pads 322, 323, and can be removed from the clamping tool 320. By operating the lever 357 in the reverse direction, the shut-off valve 310 is restored to the closed position, and the device 301 is set ready for the next clamping or welding cycle.

The drain passage 309 which is connected to the delivery passage 306 in the above embodiment may be directly connected to the pressure chamber 305 of the cylinder 304. The shut-off valve 310 may be modified as needed. For example, the valve spool 354 is threaded in the valve hole 353 so that the spool 354 is moved toward and away from the valve seat 356 when the spool 354 is rotated by a suitable operator-controlled member. Alternatively, the shut-off valve 310 may be replaced by an operator-controlled check valve wherein a valve member is automatically seated on a valve seat by the pressure in the pressure chamber 305. To allow the pressurized fluid to return to the reservoir 302 after the welding operation, a suitable member such as a push rod is operated to unseat the valve member of the check valve. In the above embodiment, the low-pressure chamber in the cylinder 304 in which the return spring 318 is disposed is exposed to the atmosphere, and the change in the volume of the pressure chamber 305 is absorbed by the second reservoir 302B having the rubber bag 333. However, the second reservoir 302B may be eliminated if the low-pressure chamber is also filled with the working fluid and communicates with the first reservoir 302A through a suitable low-pressure passage. While the piston 316 has a smaller diameter than the piston rod 317, the piston may have a larger diameter than the piston rod.

Figure 31:
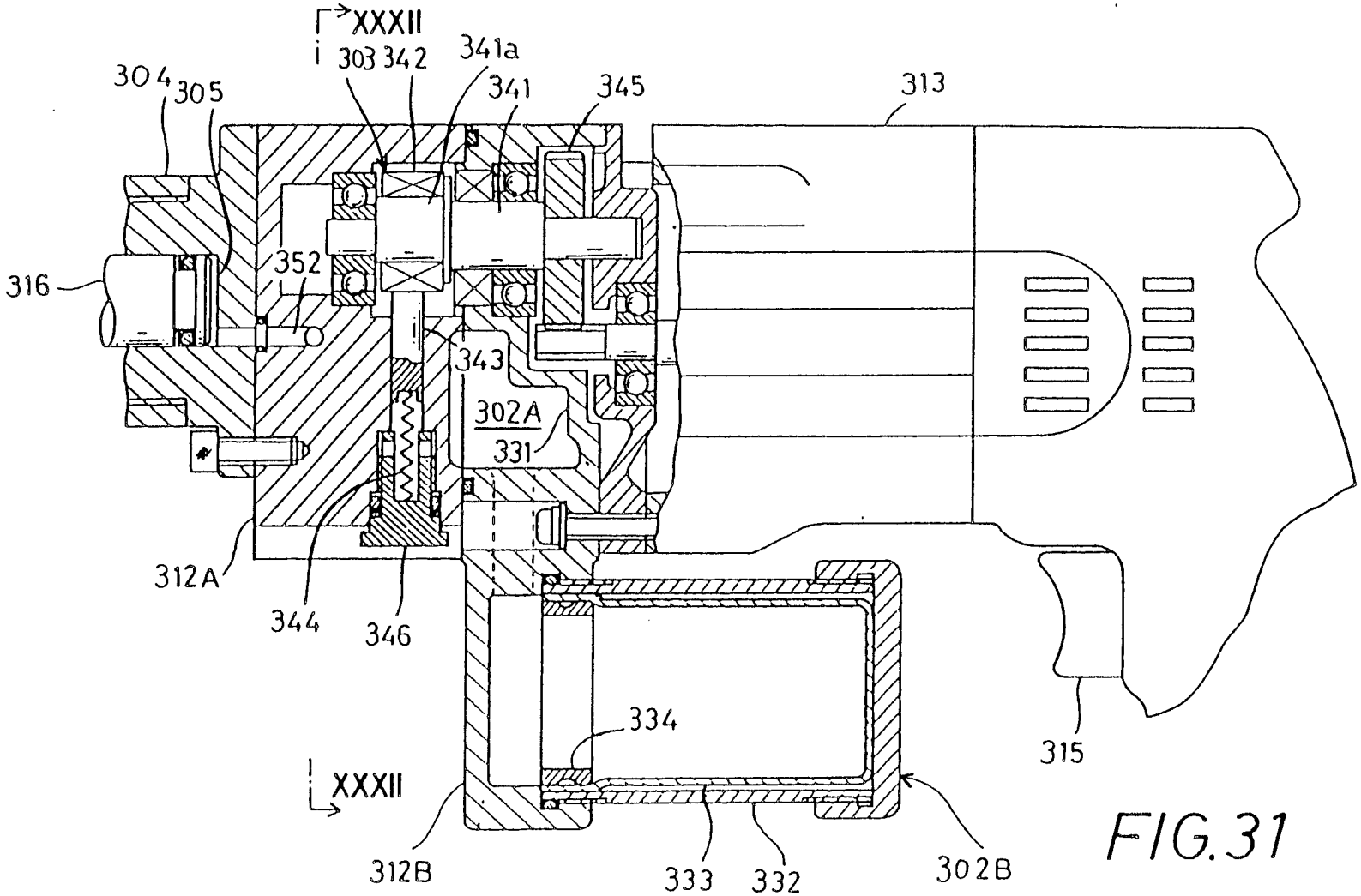
FIG. 31 is a fragmentary elevational view partly in cross section of the device of FIG. 30.
Figure 37:
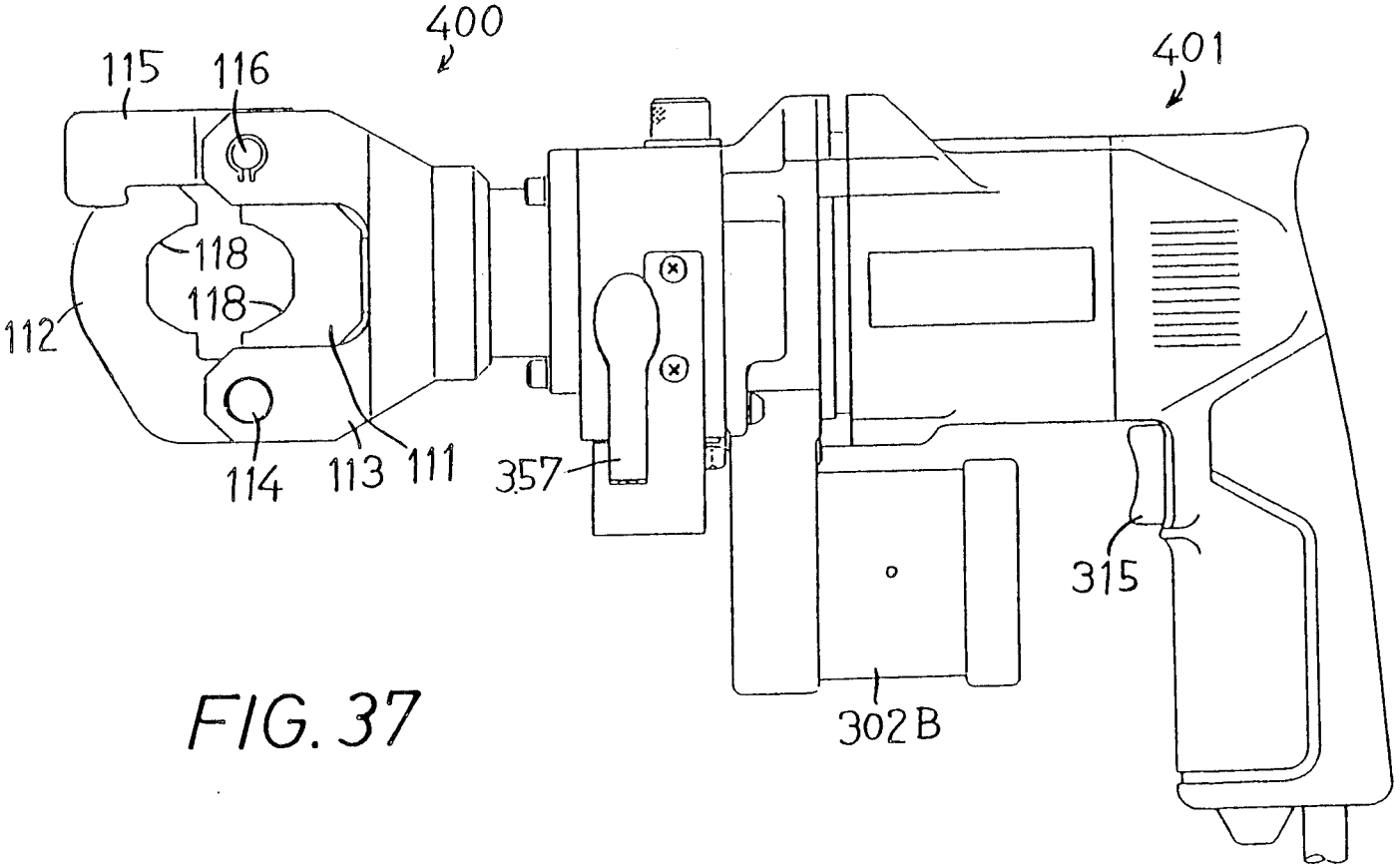
FIG. 37 is an elevational view showing a yet further embodiment of the invention.
Figure 38:
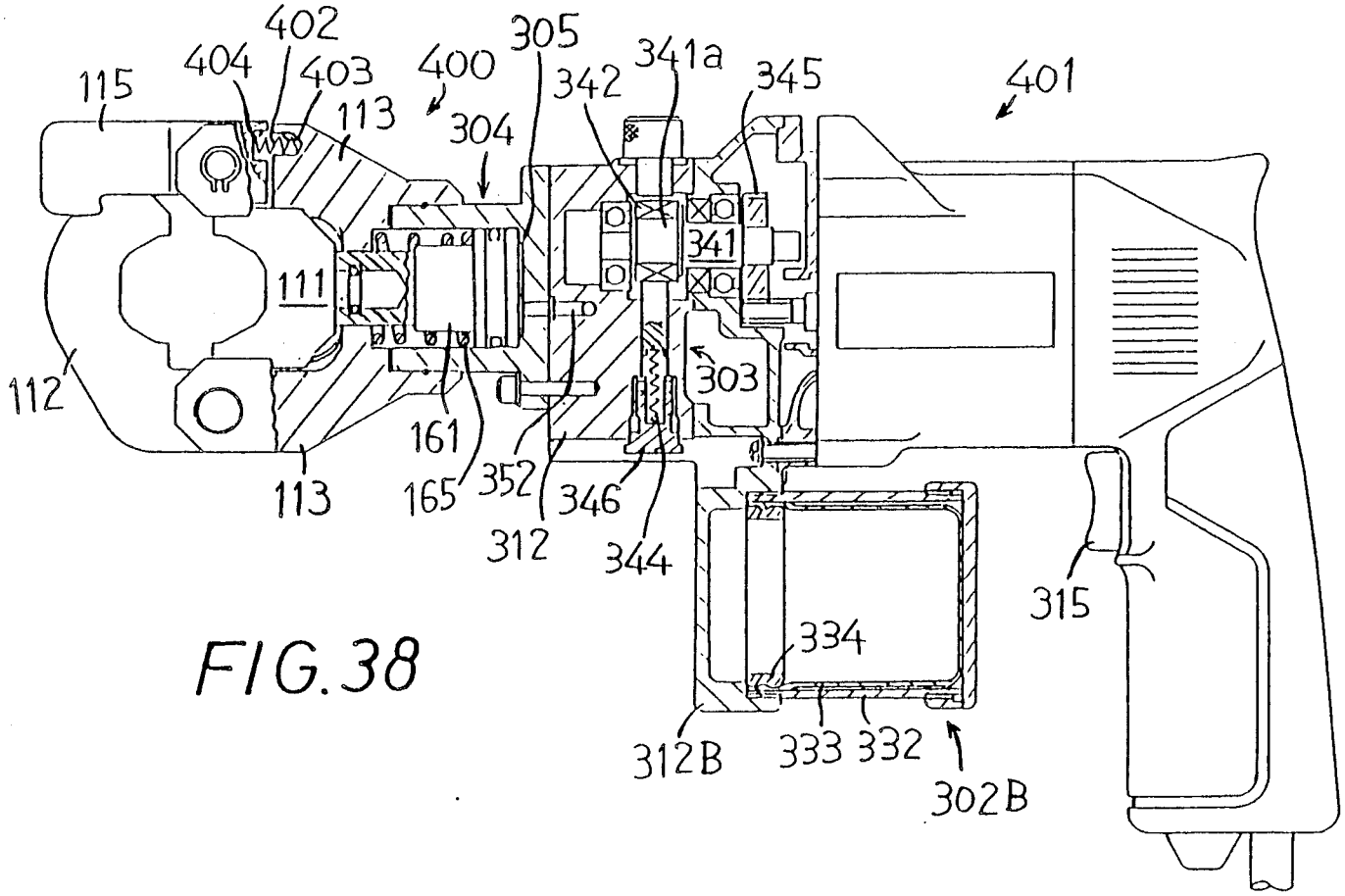
FIG. 38 is a view partly in cross section of the embodiment of FIG. 37.

Referring to FIGS. 37 and 38, there is shown another embodiment of the portable hydraulically operated device of the invention generally indicated at 401 equipped with a tool 400 having movable and retainer jaws 111, 112 as used in the embodiment of FIG. 9. The present device 401 uses the same hydraulic circuit arrangement as shown in FIG. 29, and has the same construction as shown in FIG. 31. The components not shown in FIG. 38 are the same as shown in FIGS. 32 through 35. For easier understanding, the same reference numerals as used in FIG. 9 and 31 are used in FIGS. 37 and 38, to identify the functionally corresponding components.

In the tool 400, the bracket 113 and the detent 115 have opposed surfaces which have respective holes 403, 404. A coil spring 402 is received in the holes 403, 404, so that the detent 115 is biased toward the retainer jaw 112. In this arrangement, the retainer jaw 112 is connected to the detent 115 by simply sliding the jaw 112 on the detent 115 against the biasing force of the coil spring 402.

Figure 39:
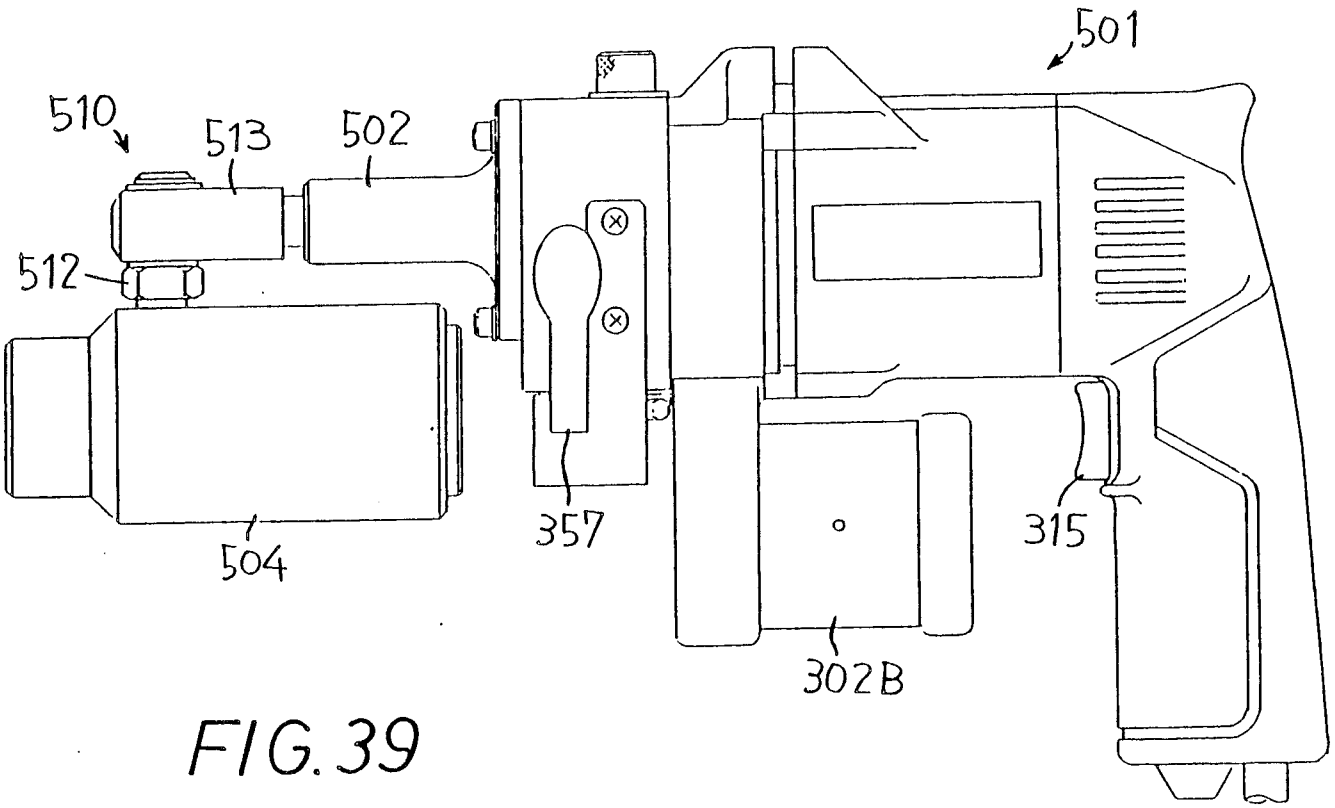
FIG. 39 is a view showing another embodiment of the invention.
Figure 40:
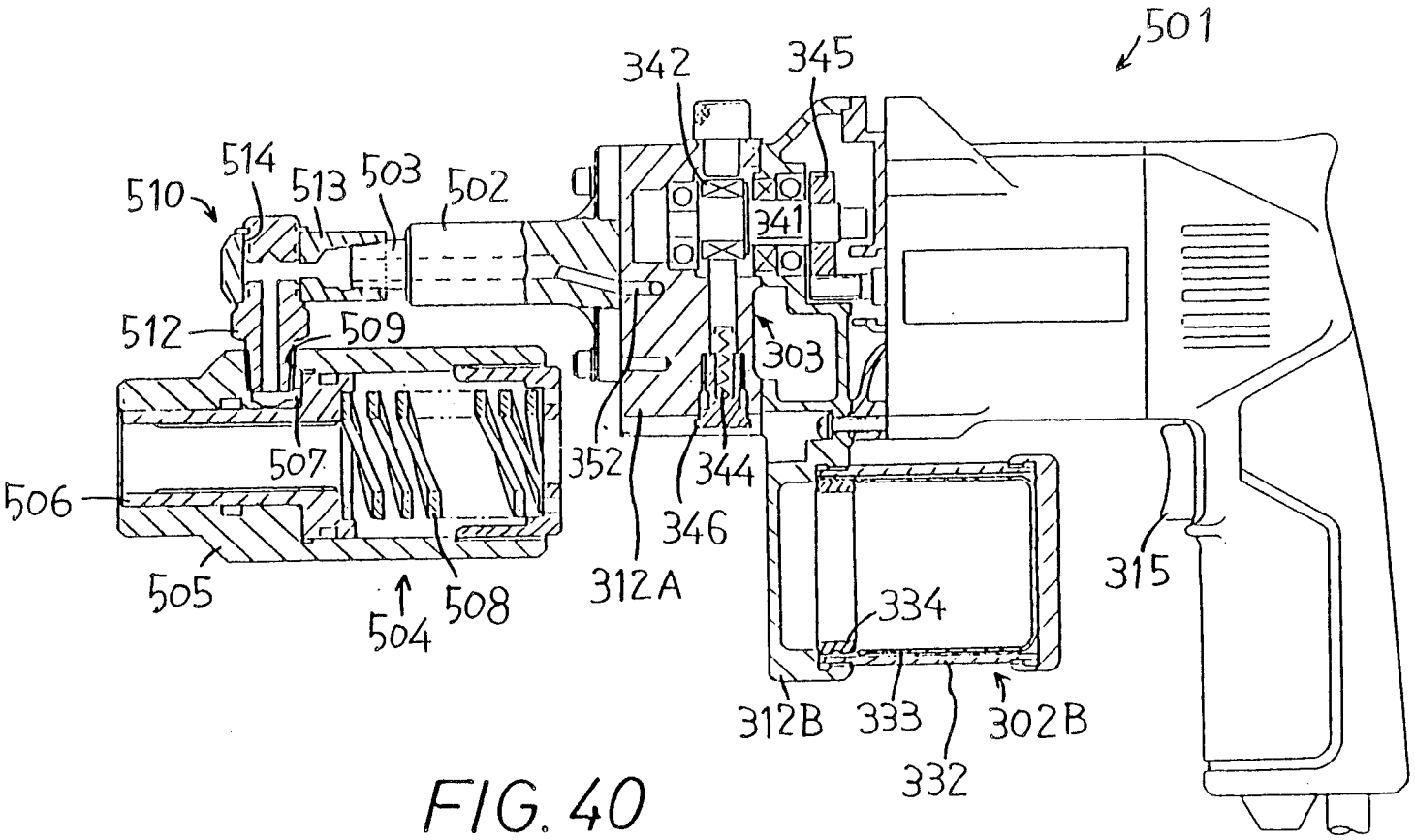
FIG. 40 is a view partly in cross section of the embodiment of FIG. 39.

A further embodiment of the invention is shown in FIGS. 39 and 40, wherein a portable hydraulically operated device 501 having the same hydraulic circuit arrangement as shown in FIG. 29 is equipped with a single-acting cylinder 504 for driving a punch. The cylinder 504 is rotatable relative to the device 501. In FIGS. 39 and 40, the same reference numerals as used in FIG. 31 are used to identify the functionally corresponding components.

The casing 312A of the device 501 has an elongate member 502 extending in the longitudinal direction of the device. An end portion 503 remote from the casing 312A has a hole communicating with the feed-discharge port 352. The single-acting cylinder 504 includes a cylinder housing 505 having a stepped bore, a stepped piston 506 received in the stepped bore, and a return spring 508 for biasing the piston 506. The housing 505 and the piston 506 define a pressure chamber 507 for receiving a pressure acting on the piston 506. The piston 506 is biased by the spring 508 in the direction to decrease the volume of the pressure chamber 507. The housing 505 has a port 509 communicating with the pressure chamber 507. The port 509 is connected to the end portion 503 of the elongate member 502 through a rotary connector 510. The connector 510 includes a first shaft member 512 threaded to the port 509, and a second shaft member 513 threaded to the end portion 503. The second shaft member 513 has a through-hole 514 through which the first shaft member 512 fluid-tightly extends such that the first shaft member 512 is pivotable about its axis. In operation, a punch is attached to an end of a holder shaft which has an externally threaded portion at the other end. The thread portion of the holder shaft is threaded in an internally threaded hole of the piston 506. The punch is driven by an advancing movement of the piston 506 with the hydraulic pressure applied to the pressure chamber 507 through the connector 510, whereby the punch is forced against a workpiece sheet supported on a female die, and a hole is formed through the sheet by the punch. The rotary connector 510 permits the cylinder 504 to be rotated about the axis of the first shaft member 512 of the device 501, namely, about an axis perpendicular to the direction of movement of a piston 506, facilitating the punching operation.

Although the several embodiments of the portable hydraulically operated device of the present invention which have been described for illustrative purpose only are adapted to perform caulking, expanding and clamping operations on the workpiece or workpieces, it is to be understood that the hydraulically operated device constructed according to the principle of the present invention may be adapted to perform any other operations involving plastic deformation of the workpiece, or cutting, drilling or other machining or processing operations. The working tool such as a punch or cutter may be attached directly to the piston rod of the single-acting cylinder, or indirectly operated by the piston rod via suitable means such as rollers driven by the piston rod. Further, the principle of the present invention is applicable to a device wherein the piston rod of the cylinder is normally held in its fully advanced (original) position by suitable biasing means, and is retracted by a hydraulic pressure to perform an intended operation.

While the present invention has been described in its presently preferred embodiments with a certain degree of particularity, it is to be understood that the invention is not limited to the details of the illustrated embodiments and their modifications described above, but may be embodied with various other changes, modifications and improvements, which may occur to those skilled in the art, without departing from the spirit and scope of the invention defined in the following claims.

What is claimed is:

1. A portable hydraulically operated clamping device comprising:

a housing;

a handle fixed to said housing for holding said portable clamping device;

a single-acting cylinder carried by said housing and having a piston, a pressure chamber for applying hydraulic pressure to the piston to move the piston from an original position to an operated position, and a return spring for biasing the piston toward the original position;

a clamping tool having at least one movable member operated by said piston for clamping a workpiece;

a hydraulic pump incorporated in said housing, for delivering a pressurized fluid to be fed into said pressure chamber of said single-acting cylinder;

an electric motor incorporated in said housing for operating said hydraulic pump;

a switch carried by said handle, for turning on and off said electric motor, said switch being finger-operable while said clamping device is hand-held at said handle;

means for defining a delivery passage for connecting said hydraulic pump and said pressure chamber of said cylinder;

an oil reservoir including a bag-like elastic member for partially defining a variable-volume chamber in which the pressurized fluid delivered from said hydraulic pump is stored;

a relief valve incorporated in said housing and connected to said delivery passage and operated when a pressure in said pressure chamber of said cylinder has reached a predetermined level;

a check valve incorporated in said housing and disposed in a portion of said delivery passage between said pressure chamber of said cylinder and a point of connection of said relief valve to said delivery passage, said check valve inhibiting a flow of pressurized fluid through said delivery passage in a direction from said pressure chamber toward said hydraulic pump; and an operator-controlled shut-off valve carried by said housing and connected to one of said pressure chamber of said cylinder and a portion of said delivery passage between said pressure chamber and said check valve, said shut-off valve being manually operated to an operated position for discharging said pressurized fluid from said pressure chamber of said cylinder, said check valve and said shut-off valve maintaining the pressure in said pressure chamber of said cylinder at said predetermined level after said hydraulic pump is turned off, until said operator-controlled shut-off valve is manually operated to said operated position.

2. A portable hydraulically operated clamping device according to claim 1, wherein said operator-controlled shut-off valve includes an axially movable valve spool, a valve seat aligned with an operating end of said valve spool, a compression coil spring for biasing said valve spool in a first direction toward said valve seat, and an operating lever for moving said valve spool in a second direction opposite to said first direction.

3. A portable hydraulically operated clamping device according to claim 1, wherein said clamping tool has a movable member as said at least one movable member, and a stationary member which is fixed to said housing and cooperates with said movable member to clamp said workpiece therebetween.

4. A portable hydraulically operated clamping device according to claim 1, said clamping tool further comprising:

a bracket mounted to said housing; and a stationary member pivotally mounted to said bracket, and wherein a movable member is said at least one moveable member, said stationary member and said moveable member working together to clamp said workpiece therebetween.

5. A portable by hydraulically operated clamping device according to claim 4, wherein said bracket has a detent for retaining said stationary member in position opposite said movable member.

6. A portable hydraulically operated clamping device according to claim 1, further comprising an oil reservoir carried by said housing and including a bag-like elastic member partially defining a variable-volume chamber in which the pressurized fluid delivered from said hydraulic pump is stored, said bag-like elastic member having opposite surfaces one of which is exposed to an atmospheric pressure and the other of which is exposed to a pressure of the fluid discharged from said pressure chamber of said cylinder, a volume of said variable-volume chamber varying with elastic deformation of said elastic member.

7. A portable hydraulically operated clamping device according to claim 6, wherein said bag-like elastic member comprises a rubber bag.

8. A portable hydraulically operated device comprising:

a housing;

a single-acting cylinder carried by said housing and having a piston for operating a working tool, a pressure chamber for applying hydraulic pressure to the piston to move the piston from an original position to an operated position, and a return spring for biasing the piston toward the original piston;

a hydraulic pump incorporated in said housing, for delivering a pressurized fluid to be fed into said pressure chamber of said single-acting cylinder;

means for defining a delivery passage for connecting said hydraulic pump and said pressure chamber of said cylinder; and a rotary connector carried by said housing and defining a portion of said delivery passage, said rotary connector supporting said single-acting cylinder such that said cylinder is rotatable about an axis perpendicular to a direction of movement of said position.

9. A portable hydraulically operated device according to claim 8, further comprising:

a relief valve incorporated in said housing and connected to said delivery passage and operated when a pressure in said pressure chamber of said cylinder has reached a predetermined level;

a check valve incorporated in said housing and disposed in a portion of said delivery passage between said pressure chamber of said cylinder and a point of connection of said relief valve to said delivery passage, said check valve inhibiting a flow of a pressurized fluid through said delivery passage in a direction from said pressure chamber toward said hydraulic pump; and an operator-controlled shut-off valve carried by said housing and connected to one of said pressure chamber of said cylinder and a portion of said delivery passage between said pressure chamber and said check valve, said shut-off valve being manually operated to an operated position for discharging said pressurized fluid from said pressure chamber of said cylinder.

said check valve and said shut-off valve maintaining the pressure in said pressure chamber of said cylinder at said predetermined level after said hydraulic pump is turned off, until said operator-controlled shut-off valve is manually operated to said operated position.

10. A portable hydraulically operated device a according to claim 8, further comprising an oil reservoir carried by said housing and including a bag-like elastic member partially defining a variable-volume chamber in which the pressurized fluid delivered from said hydraulic pump is stored, said bag-like elastic member having opposite surfaces one of which is exposed to an atmospheric pressure and the other of which is exposed to a pressure of the fluid discharged from said pressure chamber of said cylinder, a volume of said variable-volume chamber varying with elastic deformation of said elastic member.

11. A portable hydraulically operated device according to claim 8, further comprising an electric motor incorporated in said housing for operating said hydraulic pump, and a switch for turning on and off said electric motor.

12. A portable hydraulically operated device according to claim 11, further comprising a handle fixed to said housing for holding said portable device.

13. A portable hydraulically operated device according to claim 12, wherein said switch is carried by said handle.

14. A portable hydraulically operated clamping device according to claim 5, wherein faces of said stationary member and said movable member have recesses therein.

* * * * *